US011338577B2

(12) United States Patent
Nozawa

(10) Patent No.: US 11,338,577 B2
(45) Date of Patent: May 24, 2022

(54) LIQUID EJECTING APPARATUS AND DRIVE CIRCUIT

(71) Applicant: Seiko Epson Corporation, Tokyo (JP)

(72) Inventor: Dai Nozawa, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/074,728

(22) Filed: Oct. 20, 2020

(65) Prior Publication Data

US 2021/0114369 A1 Apr. 22, 2021

(30) Foreign Application Priority Data

Oct. 21, 2019 (JP) ..... JP2019-191775

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC . B41J 2/04581; B41J 2/04593; B41J 2/04541
See application file for complete search history.

(56) References Cited

U.S. PATENT DOCUMENTS

2017/0057221 A1* 3/2017 Nozawa ..... B41J 2/04541
2018/0086054 A1 3/2018 Abe

FOREIGN PATENT DOCUMENTS

JP 2018-051821 A 4/2018

* cited by examiner

*Primary Examiner* — Lam S Nguyen
(74) *Attorney, Agent, or Firm* — Harness, Dickey & Pierce, P.L.C.

(57) ABSTRACT

A liquid ejecting apparatus includes a print head that includes a first terminal and a second terminal, a first circuit substrate electrically coupled to the print head, and a second circuit substrate electrically coupled to the first circuit substrate, wherein the first circuit substrate includes a first coupling terminal electrically coupled to the print head, and a first electrolytic capacitor, wherein the second circuit substrate includes a constant voltage output circuit that outputs a constant voltage signal supplied to the second terminal, a first output terminal that is electrically coupled to the first circuit substrate, and a second output terminal that is electrically coupled to the first circuit substrate, and through which the constant voltage signal is output to the first circuit substrate, wherein the first electrolytic capacitor is electrically coupled to the second output terminal and the first coupling terminal.

6 Claims, 13 Drawing Sheets

| [SIH, SIL] | | [1, 1] LARGE DOT | [1, 0] MEDIUM DOT | [0, 1] SMALL DOT | [0, 0] NO DOTS RECORDED |
|---|---|---|---|---|---|
| S1 | T1 | H | H | H | L |
| | T2 | H | L | L | L |
| S2 | T1 | L | L | L | H |
| | T2 | L | H | L | L |

LIQUID EJECTING APPARATUS AND DRIVE CIRCUIT

The present application is based on, and claims priority from JP Application Serial Number 2019-191775, filed Oct. 21, 2019, the disclosure of which is hereby incorporated by reference herein in its entirety.

BACKGROUND

1. Technical Field

The present disclosure relates to a liquid ejecting apparatus and a drive circuit.

2. Related Art

There is known a liquid ejecting apparatus that includes a piezoelectric element such as a piezo element to print an image or a document on a medium by ejecting the ink as a liquid. The piezoelectric element is provided corresponding to each of the plurality of nozzles that ejects the ink onto the medium. A predetermined amount of ink is ejected from each of the nozzles corresponding to the respective piezoelectric elements at a predetermined timing by driving each of the piezoelectric elements in accordance with the drive signal. When the ink ejected from the nozzle lands on the medium, a dot is formed at a desired position on the medium.

Such a piezoelectric element is electrically a capacitive load, such as a capacitor, and therefore, it is necessary to supply a sufficient current to a plurality of piezoelectric elements to operate the piezoelectric elements corresponding to a plurality of nozzles. Therefore, in order to supply a sufficient current to the piezoelectric elements, the liquid ejecting apparatus includes a drive signal output circuit that includes an amplifier circuit that amplifies the supplied original signal to output it as a drive signal. The amplifier circuit included in such a drive signal output circuit, for example may include a class A amplifier circuit, a class B amplifier circuit, a class AB amplifier circuit, or the like, but from the viewpoint of power consumption reduction, in some cases, a class D amplifier circuit that is superior in energy conversion efficiency to the class A amplifier circuit, the class B amplifier circuit, and the class AB amplifier circuit is used.

Further, in response to the recent demand for further improvement in printing accuracy, the number of nozzles included in the liquid ejecting apparatus has increased, and as a result, the number of piezoelectric elements included in the liquid ejecting apparatus has also increased. Therefore, the amount of current output by the drive signal output circuit that drives the piezoelectric element is further increasing. A liquid ejecting apparatus including a plurality of drive signal output circuits is known to solve such a problem.

JP-A-2018-051821 discloses a liquid ejecting apparatus in which a plurality of circuit substrates on each of which the drive signal output circuit is mounted is included, and a plurality of circuit substrates and a relay substrate are electrically coupled to each other. In the liquid ejecting apparatus as described in JP-A-2018-051821, the circuit substrate on which the drive signal output circuit is mounted is detachably provided, so that the circuit substrate can be easily replaced. As a result, it is possible to easily change the characteristics of the drive signal output from the drive signal output circuit, it is possible to increase the versatility of the drive circuit, and when a failure occurs in the drive signal output circuit, it is possible to replace only the defective circuit substrate, so that it is possible to improve the convenience of the user.

However, when a liquid ejecting apparatus in which the circuit substrate on which the drive signal output circuit is mounted is replaceable has an increased size of the circuit substrate, the work of replacing the circuit substrate is complicated, as a result, the convenience of the user may be impaired. Therefore, in the liquid ejecting apparatus including the circuit substrate on which the drive signal output circuit is mounted and the relay substrate to which the circuit substrate is coupled, it is required to downsize the circuit substrate on which the drive signal output circuit to be replaced is mounted.

SUMMARY

According to an aspect of the present disclosure, a liquid ejecting apparatus includes a print head that includes a first terminal and a second terminal, where the print head includes a drive element that is driven by a potential difference between the first terminal and the second terminal, where the print head ejects a liquid by driving the drive element, a first circuit substrate electrically coupled to the print head, and a second circuit substrate electrically coupled to the first circuit substrate, wherein the first circuit substrate includes a first coupling terminal electrically coupled to the print head, a first electrolytic capacitor, and a first substrate on which the first coupling terminal and the first electrolytic capacitor are provided, wherein the second circuit substrate includes a drive signal output circuit that outputs a drive signal supplied to the first terminal, a constant voltage output circuit that outputs a constant voltage signal supplied to the second terminal, a first output terminal that is electrically coupled to the first circuit substrate, and through which the drive signal is output to the first circuit substrate, a second output terminal that is electrically coupled to the first circuit substrate, and through which the constant voltage signal is output to the first circuit substrate, a first input terminal that is electrically coupled to the first circuit substrate, and through which a base drive signal that is a basis of the drive signal is input from the first circuit substrate, and a second substrate on which the drive signal output circuit, the constant voltage output circuit, the first output terminal, the second output terminal, and the first input terminal are provided, wherein the first electrolytic capacitor is electrically coupled to the second output terminal and the first coupling terminal.

In the liquid ejecting apparatus, a shortest distance between the first electrolytic capacitor and the second output terminal may be shorter than a shortest distance between the first electrolytic capacitor and the first input terminal.

In the liquid ejecting apparatus, the drive signal output circuit may amplify a signal based on the base drive signal based on an amplified voltage signal to generate the drive signal, wherein the first circuit substrate may include a second coupling terminal through which the amplified voltage signal is input and a second electrolytic capacitor, wherein the second circuit substrate may include a second input terminal that is electrically coupled to the first circuit substrate, and through which the amplified voltage signal is input from the first circuit substrate, and wherein the second electrolytic capacitor may be electrically coupled to the second input terminal and the second coupling terminal.

In the liquid ejecting apparatus, a shortest distance between the second electrolytic capacitor and the second input terminal may be shorter than a shortest distance between the second electrolytic capacitor and the second output terminal.

In the liquid ejecting apparatus, when viewed from a direction orthogonal to one face of the first substrate, the first circuit substrate and the second circuit substrate may be disposed so that at least part of one face of the first substrate and one face of the second substrate overlap each other.

In the liquid ejecting apparatus, the second circuit substrate may be detachably attached to the first circuit substrate.

According to another aspect of the present disclosure, in a drive circuit including a first terminal and a second terminal, where the drive circuit drives a drive element that is driven by a potential difference between the first terminal and the second terminal, the drive circuit includes a first circuit substrate electrically coupled to the drive element, and a second circuit substrate electrically coupled to the first circuit substrate, wherein the first circuit substrate includes a first coupling terminal electrically coupled to the drive element, a first electrolytic capacitor, and a first substrate on which the first coupling terminal and the first electrolytic capacitor are provided, wherein the second circuit substrate includes a drive signal output circuit that outputs a drive signal supplied to the first terminal, a constant voltage output circuit that outputs a constant voltage signal supplied to the second terminal, a first output terminal that is electrically coupled to the first circuit substrate, and through which the drive signal is output to the first circuit substrate, a second output terminal that is electrically coupled to the first circuit substrate, and through which the constant voltage signal is output to the first circuit substrate, a first input terminal that is electrically coupled to the first circuit substrate, and through which a base drive signal that is a basis of the drive signal is input from the first circuit substrate, and a second substrate on which the drive signal output circuit, the constant voltage output circuit, the first output terminal, the second output terminal, and the first input terminal are provided, wherein the first electrolytic capacitor is electrically coupled to the second output terminal and the first coupling terminal.

DESCRIPTION OF EXEMPLARY EMBODIMENTS

Hereinafter, preferred embodiments of the present disclosure will be described with reference to the drawings. The drawings used are for convenience of explanation. The embodiments described below do not unduly limit the details of the present disclosure described in the claims. In addition, all of the configurations described below are not necessarily essential components of the disclosure.

1. Configuration of Liquid Ejecting Apparatus

Figure 1:
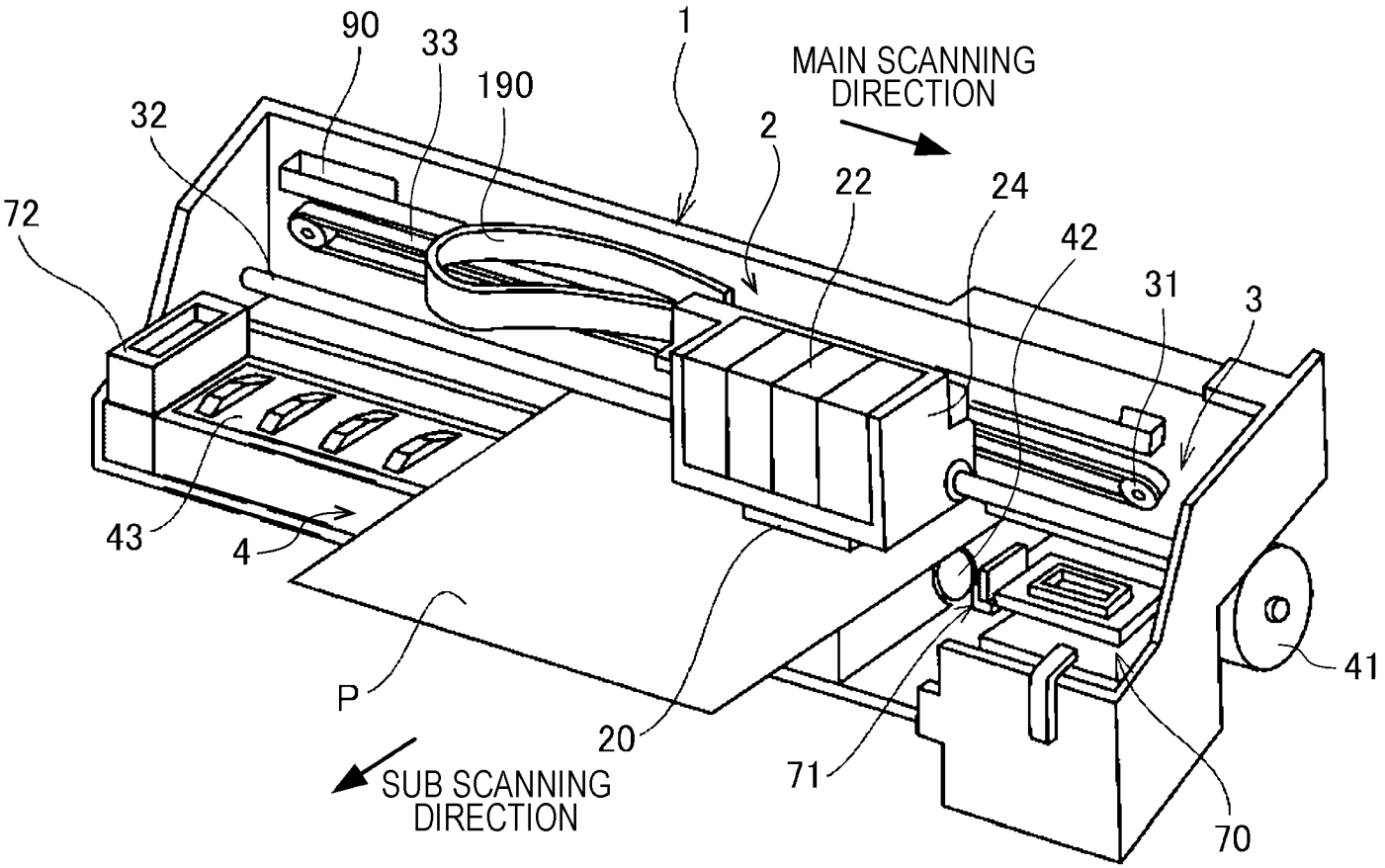
FIG. 1 is a diagram illustrating a schematic configuration of the inside of a liquid ejecting apparatus.

FIG. 1 is a diagram showing a schematic configuration of the inside of a liquid ejecting apparatus 1 of the present embodiment. The liquid ejecting apparatus 1 is an ink jet printer in which the ink as a liquid is ejected in accordance with image data supplied from a host computer provided outside to form dots on a medium P such as paper, thereby printing an image according to the supplied image data. In FIG. 1, some of the components of the liquid ejecting apparatus 1 such as a housing and a cover are not shown.

As shown in FIG. 1, the liquid ejecting apparatus 1 includes a movement mechanism 3 that moves a head unit 2 in the main scanning direction. The movement mechanism 3 includes a carriage motor 31 serving as the driving source of the head unit 2, a carriage guide shaft 32 having both ends fixed, a timing belt 33 extending substantially parallel to the carriage guide shaft 32 and driven by the carriage motor 31. The movement mechanism 3 includes a linear encoder 90 that detects the position of the head unit 2 in the main scanning direction.

A carriage 24 of the head unit 2 is configured so that a predetermined number of ink cartridges 22 can be mounted thereon. The carriage 24 is reciprocably supported by the carriage guide shaft 32 and is fixed to a portion of the timing belt 33. Accordingly, the carriage 24 of the head unit 2 is guided by the carriage guide shaft 32 and reciprocates when the carriage motor 31 causes the timing belt 33 to travel forward and backward. That is, the carriage motor 31 moves the carriage 24 in the main scanning direction. A print head 20 is attached to a portion, of the carriage 24, facing the medium P. As will be described later, the print head 20 includes a large number of nozzles, and ejects a predetermined amount of the ink from each nozzle at a predetermined timing. Various control signals are supplied to the head unit 2 operating as described above via a cable 190 such as a flexible flat cable.

The liquid ejecting apparatus 1 includes a transport mechanism 4 that transports the medium P in the sub scanning direction. The transport mechanism 4 includes a platen 43 that supports the medium P, a transport motor 41 that is a driving source, and a transport roller 42 that is rotated by the transport motor 41 and transports the medium P in the sub scanning direction. In a state where the medium P is supported by the platen 43, the ink is ejected from the print head 20 onto the medium P according to the timing at which the medium P is transported by the transport mechanism 4, so that a desired image is formed on the surface of the medium P.

A home position serving as a base point of the head unit 2 is set in an end region within the movement range of the carriage 24 included in the head unit 2. A capping member 70 that seals the nozzle formation face of the print head 20 and a wiper member 71 that wipes the nozzle formation face are disposed at the home position. The liquid ejecting apparatus 1 forms an image on the surface of the medium P bidirectionally when the carriage 24 moves forward toward the end opposite the home position, and when the carriage 24 moves backward from the opposite end toward the home position.

A flushing box 72 that collects the ink ejected from the print head 20 during a flushing operation is provided at the end of the platen 43 in the main scanning direction, and at the end opposite the home position from which the carriage 24 moves. The flushing operation is an operation of forcibly ejecting the ink from each nozzle regardless of the image data in order to prevent the possibility that the proper amount of the ink will not be ejected due to the nozzle clogging because of thickening of the ink near the nozzle, the air bubbles mixed in the nozzle, and the like. Note that the flushing boxes 72 may be provided on both sides of the platen 43 in the main scanning direction.

2. Electrical Configuration of Liquid Ejecting Apparatus

Figure 2:
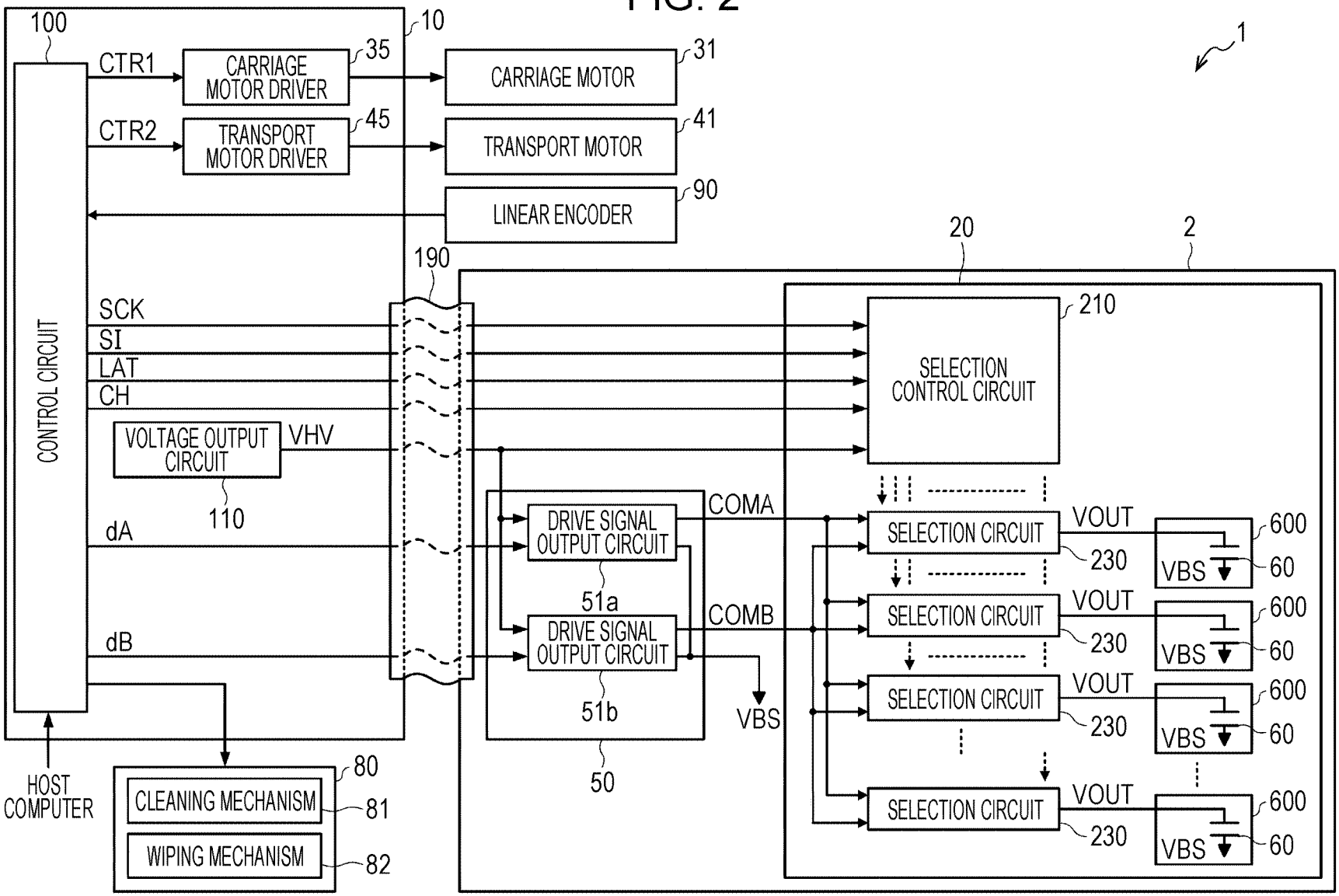
FIG. 2 is a diagram illustrating an electrical configuration of a liquid ejecting apparatus.

FIG. 2 is a diagram illustrating an electrical configuration of the liquid ejecting apparatus 1. As shown in FIG. 2, the liquid ejecting apparatus 1 includes a control unit 10 and the head unit 2. The control unit 10 and the head unit 2 are electrically coupled to each other via the cable 190.

The control unit 10 includes a control circuit 100, a carriage motor driver 35, a transport motor driver 45, and a voltage output circuit 110. The control circuit 100 generates various control signal corresponding to the image data supplied from the host computer to output the generated control signal to a corresponding configuration.

Specifically, the control circuit 100 grasps the current scanning position of the head unit 2 based on the detection signal of the linear encoder 90. The control circuit 100 generates control signals CTR1 and CTR2 corresponding to the current scanning position of the head unit 2. The control signal CTR1 is supplied to the carriage motor driver 35. The carriage motor driver 35 drives the carriage motor 31 according to the input control signal CTR1. Further, the control signal CTR2 is supplied to the transport motor driver 45. The transport motor driver 45 drives the transport motor 41 according to the input control signal CTR2. As a result, the movement of the carriage 24 in the main scanning direction and the transport of the medium P in the sub scanning direction are controlled.

In addition, the control circuit 100 generates, based on image data supplied from an externally provided host computer and a detection signal of the linear encoder 90, a clock signal SCK, a print data signal SI, a latch signal LAT, a change signal CH, and base drive signals dA and dB corresponding to the current scanning position of the head unit 2 to output the generated signals to head unit 2.

Further, the control circuit 100 causes a maintenance unit 80 to perform a maintenance process of restoring the ink ejection state of an ejection unit 600 to a normal state. The maintenance unit 80 includes a cleaning mechanism 81 and a wiping mechanism 82. The cleaning mechanism 81 performs, as a maintenance process, a pumping process of sucking the thickened ink, the air bubbles, and the like that are stored in the ejection unit 600 by a tube pump (not shown). Further, the wiping mechanism 82 performs, as a maintenance process, a wiping process of wiping foreign matter such as paper dust attached to the vicinity of the nozzle of the ejection unit 600 with the wiper member 71. The control circuit 100 may perform the above-described flushing operation as a maintenance process of restoring the ink ejection state of the ejection unit 600 to a normal state.

The voltage output circuit 110 generates a voltage VHV of a DC voltage of, for example, 42 V to output it to the head unit 2. The voltage VHV is used as a power supply voltage for various configurations of the head unit 2. Further, the voltage VHV generated by the voltage output circuit 110 may be used as a power supply voltage for various configurations of the control unit 10. Furthermore, the voltage output circuit 110 may generate a plurality of DC voltage signals having different voltage values from the voltage VHV and supply the generated DC voltage signals to the control unit 10 and the head unit 2.

The head unit 2 includes a drive circuit 50 and the print head 20.

The drive circuit 50 includes drive signal output circuits 51*a* and 51*b*. The digital base drive signal dA and the voltage VHV are input to the drive signal output circuit 51*a*. The drive signal output circuit 51*a* generates a drive signal COMA by digital-to-analog converting the input base drive signal dA to class-D amplify the converted analog signal to a voltage value corresponding to the voltage VHV. Then, the drive signal output circuit 51*a* outputs the generated drive signal COMA to the print head 20. Similarly, the digital base drive signal dB and the voltage VHV are input to the drive signal output circuit 51*b*. The drive signal output circuit 51*b* generates a drive signal COMB by digital-to-analog converting the input base drive signal dB to class-D amplify the converted analog signal to a voltage value corresponding to the voltage VHV. Then, the drive signal output circuit 51*b* outputs the generated drive signal COMB to the print head 20.

That is, the base drive signal dA defines the waveform of the drive signal COMA, and the base drive signal dB defines the waveform of the drive signal COMB. Therefore, the base drive signals dA and dB may be signals that can define the waveforms of the drive signals COMA and COMB, and may be analog signals, for example. The details of the drive signal output circuits 51*a* and 51*b* will be described later. Further, in the description of FIG. 2, the drive circuit 50 is described as being included in the head unit 2, but the drive circuit 50 may be included in the control unit 10. In this case, the drive signals COMA and COMB output from the drive signal output circuits 51*a* and 51*b* are supplied to the print head 20 via the cable 190.

The drive circuit 50 generates a constant reference voltage signal VBS having a voltage value of 5.5 V, 6 V, or the like to supply it to the print head 20. The reference voltage signal VBS is a signal of a potential serving as a reference for driving a piezoelectric element 60, and may be, for example, a signal of a ground potential.

The print head 20 includes a selection control circuit 210, a plurality of selection circuits 230, and a plurality of ejection units 600 corresponding to the plurality of respective selection circuits 230. The selection control circuit 210 generates, based on the clock signal SCK, the print data signal SI, the latch signal LAT, and the change signal CH supplied from the control circuit 100, a selection signal for selecting or deselecting the waveforms of the drive signals COMA and COMB to output the generated selection signal to each of the plurality of selection circuits 230.

The drive signals COMA and COMB and the selection signal output from the selection control circuit 210 are input to each selection circuit 230. By selecting or deselecting the waveforms of the drive signals COMA and COMB based on the input selection signal, the selection circuit 230 generates a drive signal VOUT based on the drive signals COMA and COMB to output the generated drive signal VOUT to the corresponding ejection unit 600.

Each ejection unit 600 includes a piezoelectric element 60. The drive signal VOUT output from the corresponding selection circuit 230 is supplied to one end of the piezoelectric element 60. Further, the constant reference voltage signal VBS having a voltage value of, for example 5.5 V is supplied to the other end of the piezoelectric element 60. The piezoelectric element 60 included in the ejection unit 600 is driven according to a potential difference between the drive signal VOUT supplied to the one end and the reference voltage signal VBS supplied to the other end. As a result, an amount of the ink corresponding to the driving of the piezoelectric element 60 is ejected from the ejection unit 600.

Here, the piezoelectric element 60 is an example of a drive element, and the drive signal VOUT that drives the piezoelectric element 60 is an example of a drive signal. In addition, as described above, the drive signal VOUT is generated by selecting or deselecting the waveforms of the drive signals COMA and COMB. That is, at least one of the drive signals COMA and COMB is also an example of the drive signal. At least one of the drive signal output circuits 51*a* and 51*b* that outputs the drive signals COMA and COMB is an example of a drive signal output circuit. The reference voltage signal VBS supplied to the other end of the piezoelectric element 60 is an example of a constant voltage signal.

3. Configuration of Ejection Unit

Figure 3:
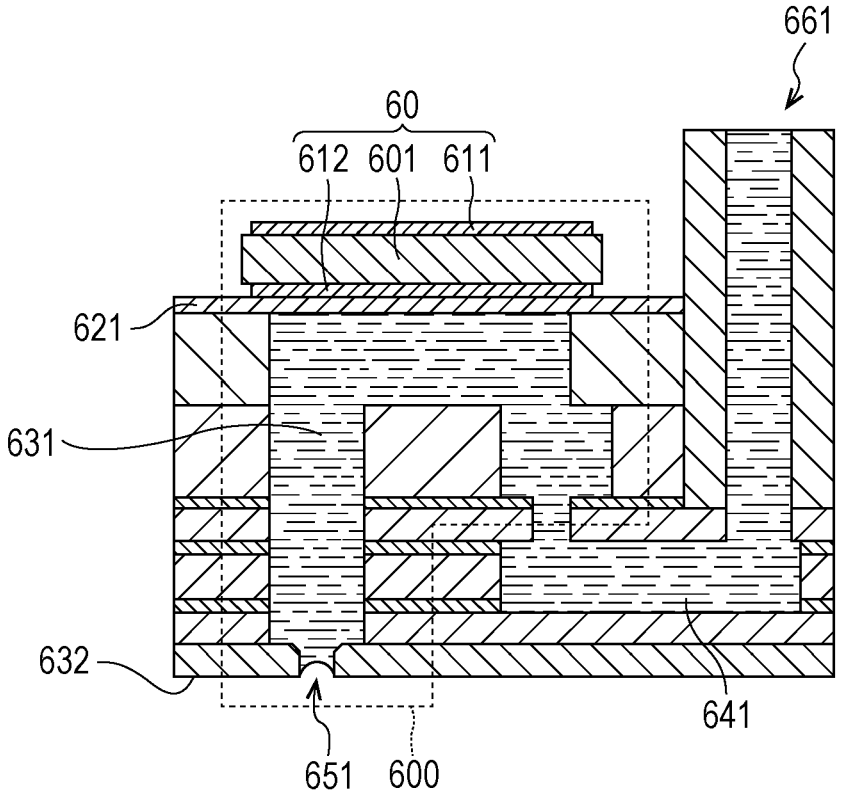
FIG. 3 is a diagram illustrating a schematic configuration of one of ejection units.

Next, the configuration of the ejection unit 600 included in the print head 20 will be described. FIG. 3 is a diagram illustrating a schematic configuration of one of the plurality of ejection units 600 included in the print head 20. As shown in FIG. 3, the ejection unit 600 includes the piezoelectric element 60, a vibration plate 621, a cavity 631, and a nozzle 651.

The cavity 631 is filled with the ink supplied from a reservoir 641. Further, the ink is introduced into the reservoir 641 from the ink cartridge 22 via an ink tube (not shown) and a supply port 661. That is, the cavity 631 is filled with the ink stored in the corresponding ink cartridge 22.

The vibration plate 621 is displaced by driving the piezoelectric element 60 provided on the upper face in FIG. 3. With the displacement of the vibration plate 621, the internal volume of the cavity 631 filled with the ink expands or contracts. That is, the vibration plate 621 functions as a diaphragm that changes the internal volume of the cavity 631.

The nozzle 651 is an opening provided in a nozzle plate 632 and communicating with the cavity 631. When the internal volume of the cavity 631 changes, an amount of the ink corresponding to the change in the internal volume is ejected from the nozzle 651.

The piezoelectric element 60 has a structure in which a piezoelectric body 601 is held between a pair of electrodes 611 and 612. In the piezoelectric body 601 having such a structure, the central portion of the electrodes 611 and 612 bends in the vertical direction together with the vibration plate 621 according to the potential difference between the voltages applied by the electrodes 611 and 612. Specifically, the drive signal VOUT is supplied to the electrode 611 of the piezoelectric element 60. Further, the reference voltage signal VBS is supplied to the electrode 612 of the piezoelectric element 60. The piezoelectric element 60 bends upward when the voltage level of the drive signal VOUT increases, and bends downward when the voltage level of the drive signal VOUT decreases.

In the ejection unit 600 configured as described above, the vibration plate 621 is displaced by the piezoelectric element 60 bending upward to increase the internal volume of the cavity 631. As a result, the ink is drawn from the reservoir 641. On the other hand, when the piezoelectric element 60 bends downward, the vibration plate 621 is displaced to reduce the internal volume of the cavity 631. As a result, an amount of the ink corresponding to the degree of reduction is ejected from the nozzle 651. That is, the print head 20 includes the electrode 611 and the electrode 612, includes the piezoelectric element 60 driven by the potential difference between the electrode 611 and the electrode 612, and ejects the ink by driving the piezoelectric element 60.

Here, the electrode 611 supplied with the drive signal VOUT is an example of a first terminal, and the electrode 612 supplied with the reference voltage signal VBS is an example of a second terminal. The piezoelectric element 60 is not limited to the structure shown in FIG. 3, but may have any structure as long as it can eject the ink from the ejection unit 600. Therefore, the piezoelectric element 60 is not limited to the above-described configuration of the bending vibration, but may be, for example, a configuration using the longitudinal vibration.

4. Configuration and Operation of Print Head

Next, the configuration and operation of the print head 20 will be described. As described above, the print head 20 generates the drive signal VOUT by selecting or deselecting the drive signals COMA and COMB output from the drive circuit 50 based on the clock signal SCK, the print data signal SI, the latch signal LAT, and the change signal CH to supply the generated drive signal VOUT to the corresponding ejection unit 600. Therefore, in describing the configuration and operation of the print head 20, first, an example of the waveforms of the drive signals COMA and COMB and an example of the waveform of the drive signal VOUT will be described.

Figure 4:
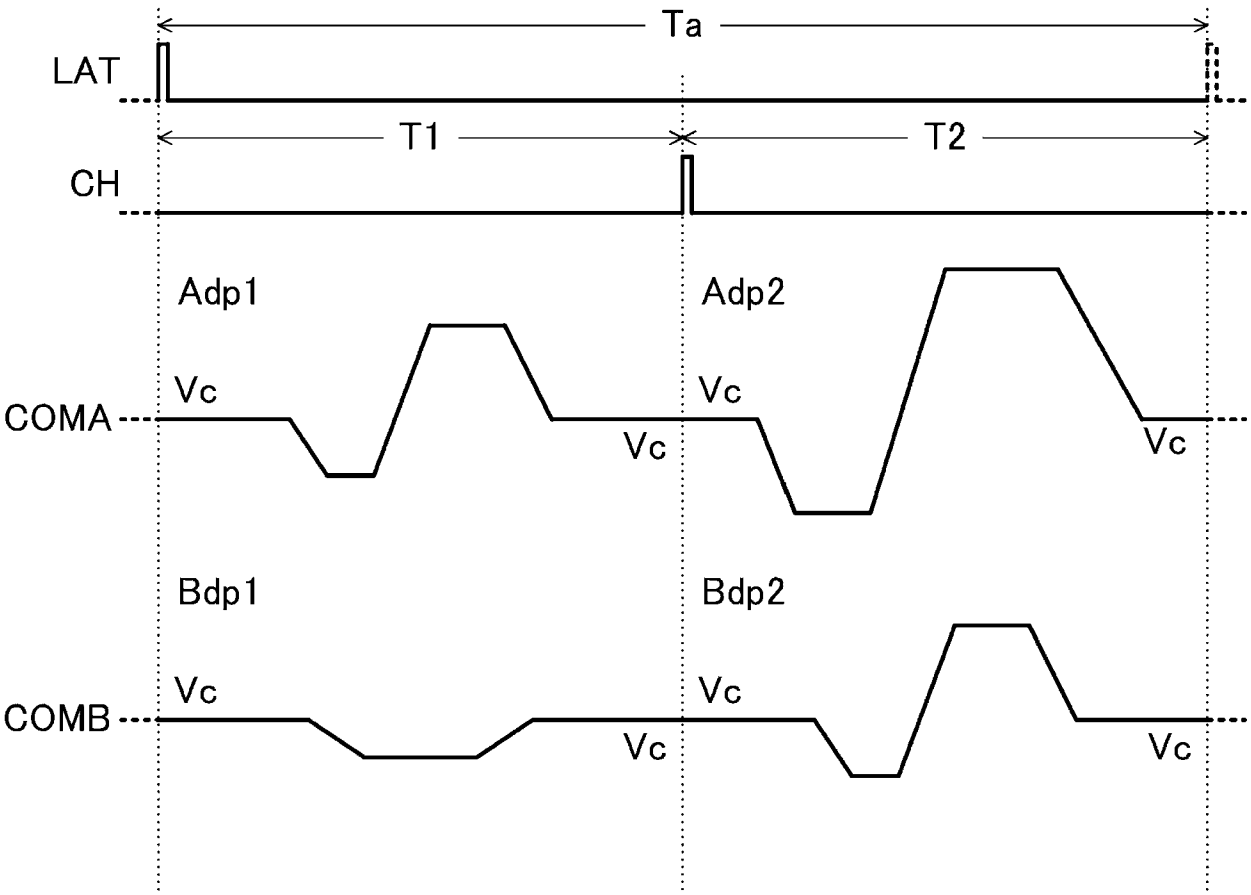
FIG. 4 is a diagram illustrating an example of waveforms of drive signals COMA and COMB.

FIG. 4 is a diagram illustrating an example of the waveforms of the drive signals COMA and COMB. As shown in FIG. 4, the drive signal COMA includes a waveform in which a trapezoidal waveform Adp1 disposed in a period T1 from the rise of the latch signal LAT to the rise of the change signal CH, and a trapezoidal waveform Adp2 disposed in a period T2 from the rise of the change signal CH to the rise of the latch signal LAT are continuous. The trapezoidal waveform Adp1 is a waveform for ejecting a small amount of the ink from the nozzle 651, and the trapezoidal waveform Adp2 is a waveform for ejecting a medium amount of the ink that is larger than the small amount of the ink from the nozzle 651.

Further, the drive signal COMB includes a waveform in which a trapezoidal waveform Bdp1 disposed in the period T1 and a trapezoidal waveform Bdp2 disposed in the period T2 are continuous. The trapezoidal waveform Bdp1 is a waveform for not ejecting the ink from the nozzle 651, and is a waveform for preventing an increase in the ink viscosity by vibrating the ink near the opening of the nozzle 651. Further, as in the trapezoidal waveform Adp1, the trapezoidal waveform Bdp2 is a waveform for ejecting a small amount of the ink from the nozzles 651.

The voltages at the start timing and the end timing of each of the trapezoidal waveforms Adp1, Adp2, Bdp1, and Bdp2 are commonly a voltage Vc. That is, each of the trapezoidal waveforms Adp1, Adp2, Bdp1, and Bdp2 is a waveform that starts at the voltage Vc and ends at the voltage Vc. A cycle Ta including the period T1 and the period T2 corresponds to a printing cycle in which a new dot is formed on the medium P.

Here, in FIG. 4, the trapezoidal waveform Adp1 and the trapezoidal waveform Bdp2 are identical, but the trapezoidal waveform Adp1 and the trapezoidal waveform Bdp2 may be different. Further, the description is made assuming that a small amount of the ink is ejected from the corresponding nozzle 651 when the trapezoidal waveform Adp1 is supplied to the ejection unit 600, and when the trapezoidal waveform Bdp1 is supplied to the ejection unit 600, but different amounts of the ink may be ejected. That is, the waveforms of the drive signals COMA and COMB are not limited to the waveforms shown in FIG. 4, but various waveforms may be combined depending on the moving speed of the carriage 24 to which the print head 20 is attached, the nature of the ink stored in the ink cartridge 22, the material of the medium P, and the like.

Figure 5:
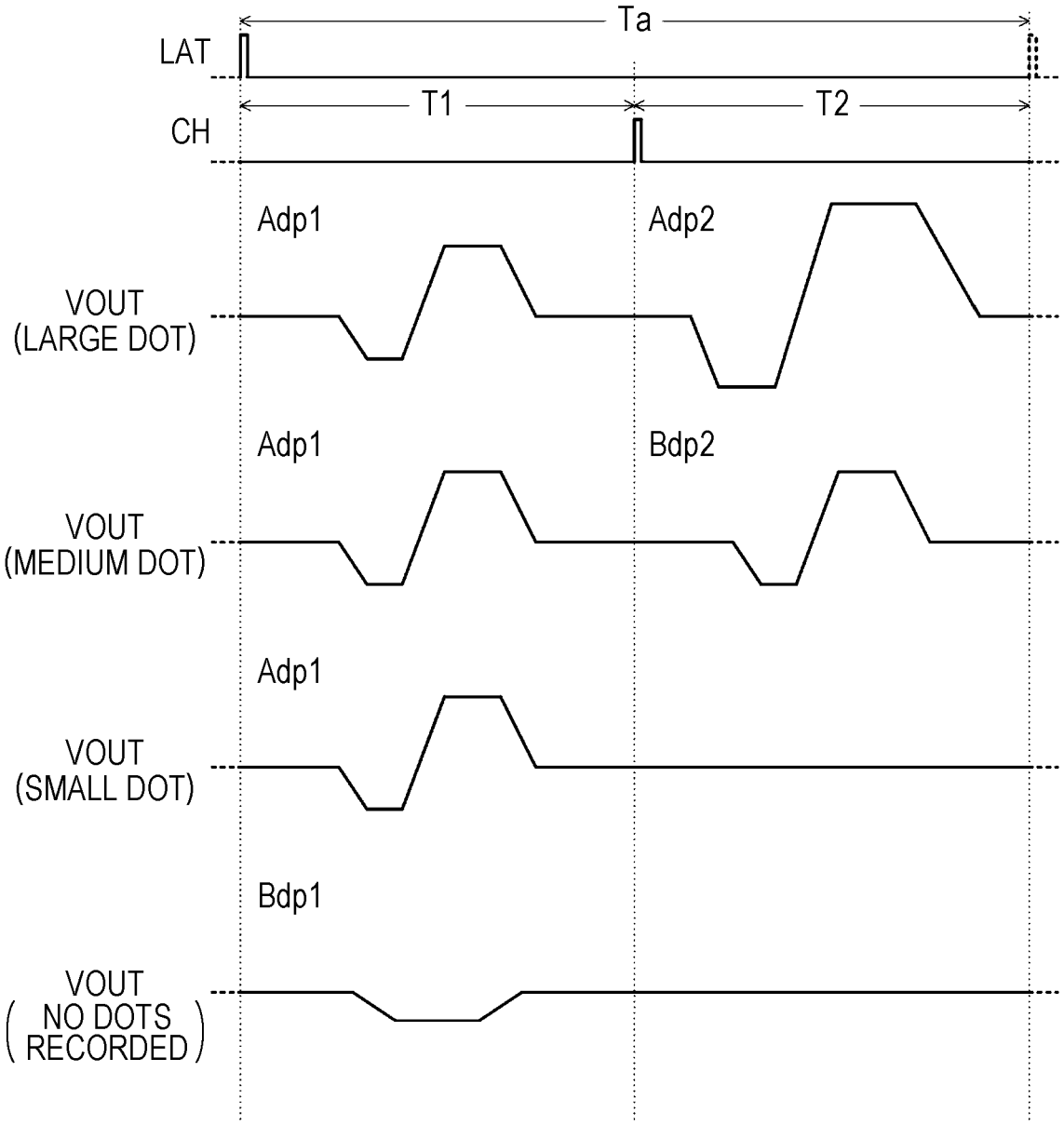
FIG. 5 is a diagram illustrating an example of waveforms of a drive signal VOUT.

FIG. 5 is a diagram illustrating an example of the waveform of the drive signal VOUT. FIG. 5 shows the waveforms of the drive signal VOUT with the dots formed on the medium P having the sizes of the "large dot", the "medium dot", and the "small dot", and "no dots recorded" in comparison.

As shown in FIG. 5, the drive signal VOUT when the "large dot" is formed on the medium P represents a waveform in the cycle Ta in which the trapezoidal waveform Adp1 disposed in the period T1, and the trapezoidal waveform Adp2 disposed in the period T2 are continuous. When the drive signal VOUT is supplied to the ejection unit 600, a small amount of the ink and a medium amount of the ink are ejected from the corresponding nozzle 651 in the cycle Ta. Therefore, the large dot is formed on the medium P by landing and uniting the respective amounts of the ink.

The drive signal VOUT when the "medium dot" is formed on the medium P represents a waveform in the cycle Ta in which the trapezoidal waveform Adp1 disposed in the period T1, and the trapezoidal waveform Bdp2 disposed in the period T2 are continuous. When the drive signal VOUT is supplied to the ejection unit 600, a small amount of the ink is ejected twice from the corresponding nozzle 651 in the cycle Ta. Therefore, the medium dot is formed on the medium P by landing and uniting the respective amounts of the ink.

The drive signal VOUT when the "small dot" is formed on the medium P represents a waveform in the cycle Ta in which the trapezoidal waveform Adp1 disposed in the period T1, and a constant waveform, with the voltage Vc, disposed in the period T2 are continuous. When the drive signal VOUT is supplied to the ejection unit 600, a small amount of the ink is ejected from the corresponding nozzle 651 in the cycle Ta. Therefore, this amount of the ink lands on the medium P to form the small dot.

The drive signal VOUT corresponding to the "no dots recorded" in which no dots are formed on the medium P represents a waveform in the cycle Ta in which the trapezoidal waveform Bdp1 disposed in period T1, and a constant waveform, with the voltage Vc, disposed in the period T2 are continuous. When the drive signal VOUT is supplied to the ejection unit 600, the ink near the opening of the corresponding nozzle 651 only slightly vibrates, and no ink is ejected in the cycle Ta. Therefore, the ink does not land on the medium P and no dots are formed.

Here, the waveform that is constant at the voltage Vc is a waveform with a voltage of the immediately preceding voltage Vc being held in the piezoelectric element 60, which is a capacitive load, when none of the trapezoidal waveforms Adp1, Adp2, Bdp1, and Bdp2 is selected as the drive signal VOUT. Therefore, when none of the trapezoidal waveforms Adp1, Adp2, Bdp1, and Bdp2 is selected as the drive signal VOUT, it can be said that the voltage Vc is supplied to the ejection unit 600 as the drive signal VOUT.

The drive signal VOUT as described above is generated when the waveforms of the drive signals COMA and COMB are selected or deselected by the operation of the selection control circuit 210 and the selection circuit 230.

Figure 6:
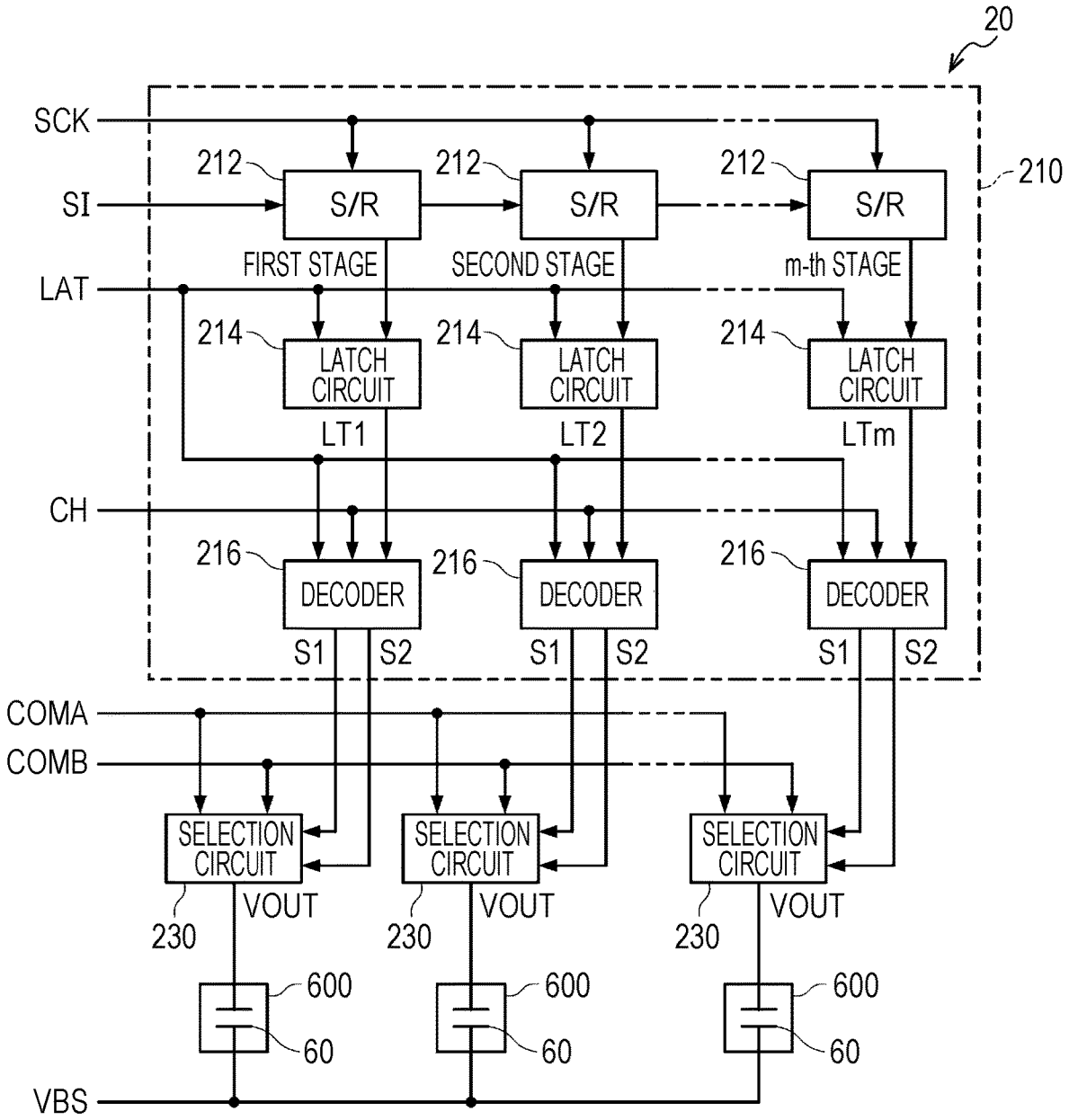
FIG. 6 is a diagram illustrating a configuration of a selection control circuit and a selection circuit.

FIG. 6 is a diagram illustrating configurations of the selection control circuit 210 and the selection circuits 230. As shown in FIG. 6, the print data signal SI, the latch signal LAT, the change signal CH, and the clock signal SCK are input to the selection control circuit 210. The selection control circuit 210 includes a set of a shift register (S/R) 212, a latch circuit 214, and a decoder 216 corresponding to each of the m ejection units 600. That is, the selection control circuit 210 includes the same number of sets of the shift registers 212, the latch circuits 214, and the decoders 216 as the m ejection units 600.

The print data signal SI is a signal synchronized with the clock signal SCK, and is a total 2·m-bit signal including 2-bit print data [SIH, SIL] for selecting any one of the "large dot", the "medium dot", the "small dot", and the "no dots recorded" for each of the m ejection units 600. The input print data signal SI is held in the shift register 212 for 2-bit print data [SIH, SIL] included in the print data signal SI corresponding to each of the m ejection units 600. Specifically, the selection control circuit 210 is configured such that the m-stage shift registers 212 corresponding to the m ejection units 600 are cascade-coupled to each other, and the print data signal SI input serially is sequentially transferred to the subsequent stage according to the clock signal SCK. In FIG. 6, in order to distinguish the shift registers 212, they are denoted as the first stage, the second stage . . . the m-th stage in order from the upstream shift register to which the print data signal SI is input.

Each of the m latch circuits 214 latches the 2-bit print data [SIH, SIL] held by the respective m shift registers 212 at the rising edge of the latch signal LAT.

Figures 7, 8:
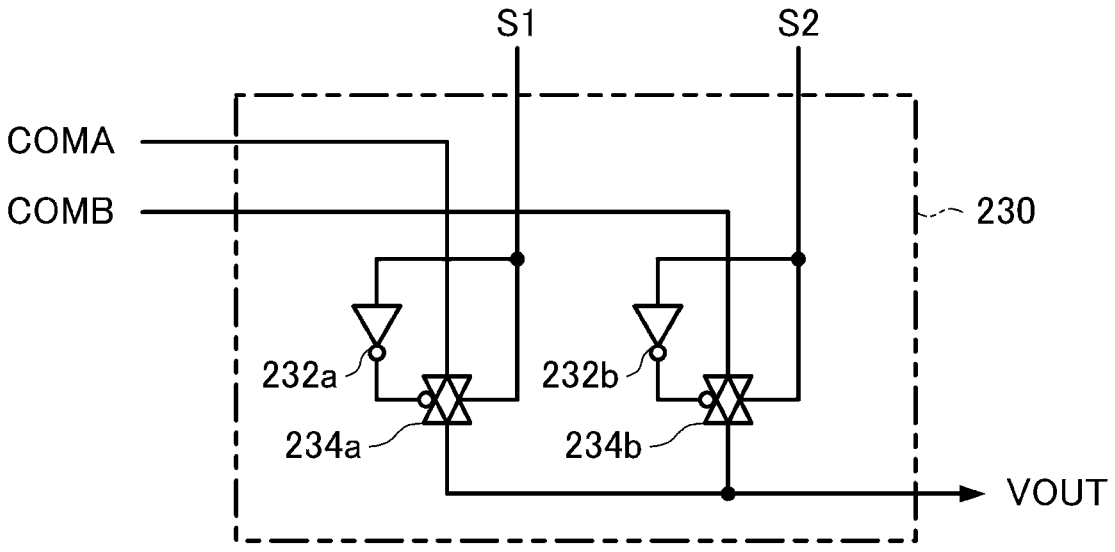
FIG. 7 is a diagram illustrating the decoding contents in a decoder.
FIG. 8 is a diagram illustrating a configuration of a selection circuit corresponding to one ejection unit.

FIG. 7 is a diagram illustrating the decoding contents in the decoder 216. The decoder 216 outputs selection signals S1 and S2 according to the 2-bit print data [SIH, SIL] latched by the latch circuit 214. For example, when the 2-bit print data [SIH, SIL] is [1, 0], the decoder 216 outputs the logic level of the selection signal S1 as H and L levels in the periods T1 and T2, and the logic level of the selection signal S2 as L and H levels in the periods T1 and T2 to the selection circuit 230.

The selection circuit 230 is provided corresponding to each of the ejection units 600. That is, the number of the selection circuits 230 included in the print head 20 is m, which is the same as the total number of the ejection units 600. FIG. 8 is a diagram illustrating a configuration of the selection circuit 230 corresponding to one ejection unit 600. As shown in FIG. 8, the selection circuit 230 includes inverters 232*a* and 232*b*, which are NOT circuits, and transfer gates 234*a* and 234*b*.

The selection signal S1 is input to the non-circled positive control end in the transfer gate 234*a*, while being input to the circled negative control end in the transfer gate 234*a* after logically inverted by the inverter 232*a*. The drive signal COMA is supplied to the input end of the transfer gate 234*a*. The selection signal S2 is input to the non-circled positive control end in the transfer gate 234*b*, while being input to the circled negative control end in the transfer gate 234*b* after logically inverted by the inverter 232*b*. The drive signal COMB is supplied to the input end of the transfer gate 234*b*. The output ends of the transfer gates 234*a* and 234*b* are coupled in common and the drive signal COMA and the drive signal COMB are output as the drive signal VOUT.

Specifically, when the selection signal S1 is at H level, the transfer gate 234*a* is brought into a conductive state between the input end and the output end, and when the selection signal S1 is at L level, the transfer gate 234*a* is brought into a non-conductive state between the input end and the output end. When the selection signal S2 is at H level, the transfer gate 234*b* is brought into a conductive state between the input end and the output end, and when the selection signal S2 is at L level, the transfer gate 234*b* is brought into a non-conductive state between the input end and the output end. As described above, the selection circuit 230 generates and output the drive signal VOUT by selecting the waveforms of the drive signals COMA and COMB based on the selection signals S1 and S2.

Figure 9:
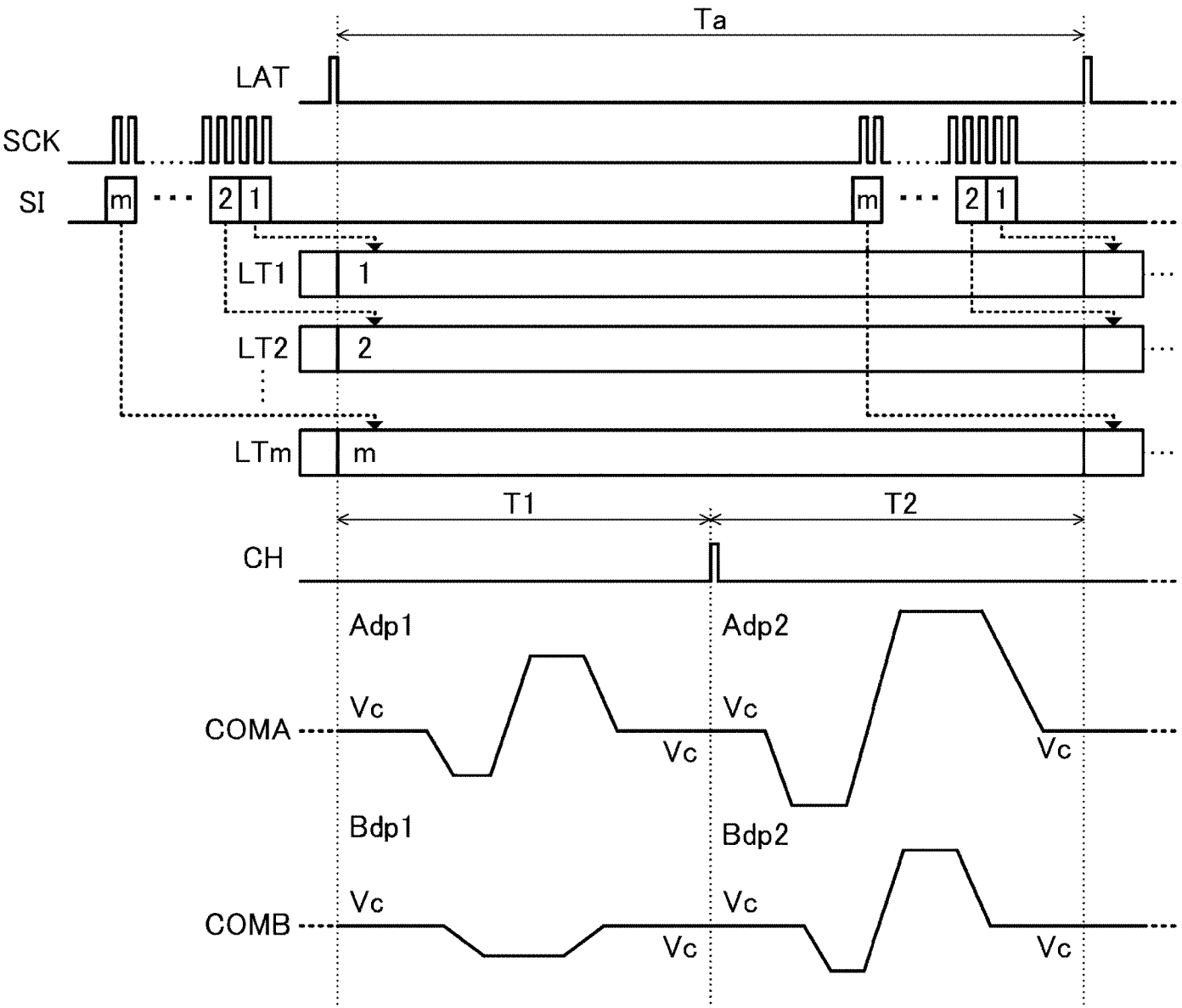
FIG. 9 is a diagram for explaining an operation of the selection control circuit and the selection circuit.

Here, operations of the selection control circuit 210 and the selection circuit 230 will be described with reference to FIG. 9. FIG. 9 is a diagram for explaining the operations of the selection control circuit 210 and the selection circuit 230. The print data signal SI is serially input in synchronization with the clock signal SCK, and is sequentially transferred to the shift registers 212 corresponding to the respective ejection units 600. When the input of the clock signal SCK stops, each shift register 212 holds 2-bit print data [SIH, SIL] corresponding to each of the ejection units 600. The print data signal SI is input to the shift registers 212 of the m-th stage . . . the second stage, the first-stage in the order of the corresponding ejection units 600.

When the latch signal LAT rises, each of the latch circuits 214 simultaneously latches the 2-bit print data [SIH, SIL] held in the respective shift registers 212. In FIG. 9, LT1, LT2 . . . LTm indicate 2-bit print data [SIH, SIL] latched by the latch circuits 214 corresponding to the shift registers 212 of the first stage, the second stage . . . the m-th stage, respectively.

The decoder 216 outputs the logic levels of the selection signals S1 and S2 according to the contents as shown in FIG. 7 in each of the periods T1 and T2 according to a dot size defined by the latched 2-bit print data [SIH, SIL].

Specifically, when the print data [SIH, SIL] is [1, 1], the decoder 216 sets the selection signal S1 to H and H levels in the periods T1 and T2, and sets the selection signal S2 to L and L levels in the periods T1 and T2. In this case, the selection circuit 230 selects the trapezoidal waveform Adp1 in the period T1, and selects the trapezoidal waveform Adp2 in the period T2. As a result, the drive signal VOUT corresponding to the "large dot" shown in FIG. 5 is generated.

Also, when the print data [SIH, SIL] is [1, 0], the decoder 216 sets the selection signal S1 to H and L levels in the periods T1 and T2, and sets the selection signal S2 to L and H levels in the periods T1 and T2. In this case, the selection circuit 230 selects the trapezoidal waveform Adp1 in the period T1, and selects the trapezoidal waveform Bdp2 in the period T2. As a result, the drive signal VOUT corresponding to the "medium dot" shown in FIG. 5 is generated.

Further, when the print data [SIH, SIL] is [0, 1], the decoder 216 sets the selection signal S1 to H and L levels in the periods T1 and T2, and sets the selection signal S2 to L and L levels in the periods T1 and T2. In this case, the selection circuit 230 selects the trapezoidal waveform Adp1 in the period T1, and selects none of the trapezoidal waveforms Adp2 and Bdp2 in the period T2. As a result, the drive signal VOUT corresponding to the "small dot" shown in FIG. 5 is generated.

Further, when the print data [SIH, SIL] is [0, 0], the decoder 216 sets the selection signal S1 to L and L levels in the periods T1 and T2, and sets the selection signal S2 to the H and L levels in the periods T1 and T2. In this case, the selection circuit 230 selects the trapezoidal waveform Bdp1 in the period T1, and selects none of the trapezoidal waveforms Adp2 and Bdp2 in the period T2. As a result, the drive signal VOUT corresponding to "no dots recorded" shown in FIG. 5 is generated.

As mentioned above, the selection control circuit 210 and the selection circuit 230 select the waveforms of the drive signals COMA and COMB based on the print data signal SI, the latch signal LAT, the change signal CH, and the clock signal SCK to output the selected waveforms as the drive signal VOUT to the ejection unit 600.

5. Configuration of Drive Signal Output Circuit

Next, the configuration and operation of the drive signal output circuits 51*a* and 51*b* that output the drive signals COMA and COMB will be described. Here, the drive signal output circuit 51*a* and the drive signal output circuit 51*b* have the same configuration except that the input signal and the output signal are different. Therefore, in the following description, only the configuration and operation of the drive signal output circuit 51*a* will be described, and the description of the configuration and operation of the drive signal output circuit 51*b* will be omitted.

Figure 10:
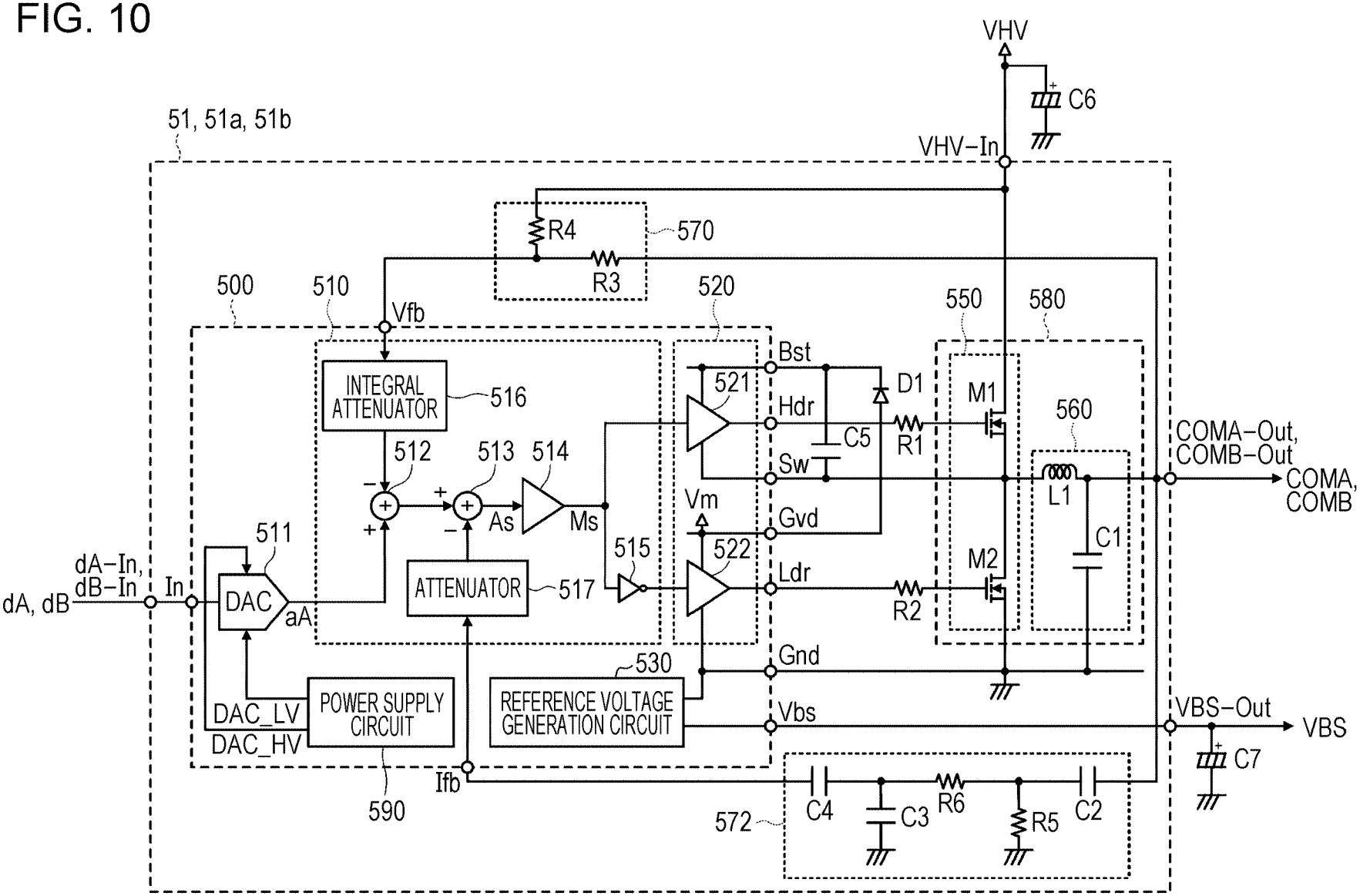
FIG. 10 is a diagram illustrating a circuit configuration of a drive signal output circuit.

In FIG. 10, in addition to the base drive signal dA input to the drive signal output circuit 51*a*, a terminal dA-In through which the base drive signal dA is input to the drive signal output circuit 51*a*, the drive signal COMA output from the drive signal output circuit 51*a*, and a terminal COMA-Out through which the drive signal COMA is output from the drive signal output circuit 51*a*, the base drive signal dB input to the drive signal output circuit 51*b*, a terminal dB-In through which the base drive signal dB is input to the drive signal output circuit 51*b*, the drive signal COMB output from the drive signal output circuit 51*b*, and a terminal COMB-Out through which the drive signal COMB is output from the drive signal output circuit 51*b* are shown.

First, the drive signal output circuit 51*a* analog converts the base drive signal dA. The drive signal output circuit 51*a* feeds back the output drive signal COMA, and corrects the deviation between the attenuation signal based on the drive signal COMA and the base drive signal dA converted into the analog signal by a high-frequency component of the drive signal COMA to generate a modulation signal according to the corrected signal. Afterwards, the drive signal output circuit 51*a* switches transistors M1 and M2 according to the modulation signal, and amplify the modulation signal to a voltage value based on the voltage VHV to generate an amplified modulation signal. Then, the drive signal output circuit 51*a* demodulates the amplified modulation signal by smoothing the amplified modulation signal with a low-pass filter to output the demodulated signal as the drive signal COMA. That is, the drive signal output circuit 51*a* generates and outputs the drive signal COMA by amplifying the signal based on the base drive signal dA based on the voltage VHV.

FIG. 10 is a diagram illustrating a circuit configuration of the drive signal output circuit 51*a*. As shown in FIG. 10, the drive signal output circuit 51*a* includes an integrated circuit 500, an output circuit 580, a first feedback circuit 570, a second feedback circuit 572, and a plurality of other circuit elements.

The integrated circuit 500 is electrically coupled to the outside of the integrated circuit 500 through a plurality of terminals including a terminal In, a terminal Bst, a terminal Hdr, a terminal Sw, a terminal Gvd, a terminal Ldr, a terminal Gnd, and a terminal Vbs. The integrated circuit 500 modulates the base drive signal dA input from the terminal In to output an amplification control signal for driving each of the transistors M1 and M2 included in an amplifier circuit 550 included in the output circuit 580.

As shown in FIG. 10, the integrated circuit 500 includes a digital to analog converter (DAC) 511, a modulation circuit 510, a gate drive circuit 520, a reference voltage generation circuit 530, and a power supply circuit 590.

The power supply circuit 590 generates a first voltage signal DAC_HV and a second voltage signal DAC_LV to supply them to the DAC 511.

The DAC 511 converts the digital base drive signal dA that defines the waveform of the drive signal COMA input via the terminal dA-In into the base drive signal aA that is an analog signal having a voltage value between the first voltage signal DAC_HV and the second voltage signal DAC_LV to output the converted base drive signal aA to the modulation circuit 510. Note that the maximum value of the voltage amplitude of the base drive signal aA is defined by the first voltage signal DAC_HV, and the minimum value is defined by the second voltage signal DAC_LV. That is, the first voltage signal DAC_HV is a reference voltage of the DAC 511 on the high voltage side, and the second voltage signal DAC_LV is a reference voltage of the DAC 511 on the low voltage side. A signal obtained by amplifying the analog base drive signal aA is the drive signal COMA. That is, the base drive signal aA corresponds to a target signal before the amplification of the drive signal COMA. The voltage amplitude of the base drive signal aA in the present embodiment is, for example, 1 V to 2 V.

The modulation circuit 510 generates the modulation signal Ms obtained by modulating the base drive signal aA to output the generated modulation signal Ms to the amplifier circuit 550 via the gate drive circuit 520. Modulation circuit 510 includes adders 512 and 513, a comparator 514, an inverter 515, an integral attenuator 516, and an attenuator 517.

The integral attenuator 516 attenuates and integrates the voltage of the terminal COMA-Out input via a terminal Vfb, that is, the drive signal COMA, and supplies the attenuated and integrated signal to a negative input end of the adder 512. The base drive signal aA is input to a positive input end of the adder 512. The adder 512 supplies a voltage obtained by subtracting and integrating the voltage input to the negative input end from the voltage input to the positive input end to the positive input end of the adder 513.

Here, the maximum value of the voltage amplitude of the base drive signal aA is about 2 V as described above, whereas the maximum value of the voltage of the drive signal COMA may exceed 40 V in some cases. For this reason, the integral attenuator 516 attenuates the voltage of the drive signal COMA input via the terminal Vfb in order to match the amplitude ranges of both voltages when obtaining the deviation.

The attenuator 517 supplies a voltage obtained by attenuating the high-frequency component of the drive signal COMA input via a terminal Ifb to the negative input end of the adder 513. Further, the voltage output from the adder 512 is input to the positive input end of the adder 513. The adder 513 outputs to the comparator 514 the voltage signal As obtained by subtracting the voltage input to the negative input end from the voltage input to the positive input end.

The voltage signal As output from the adder 513 is a voltage obtained by subtracting the voltage of the signal supplied to the terminal Vfb and further subtracting the voltage of the signal supplied to the terminal Ifb from the voltage of the base drive signal aA. For this reason, the voltage of the voltage signal As output from the adder 513 is a signal obtained by correcting the deviation obtained by subtracting the attenuation voltage of the drive signal COMA from the target voltage of the base drive signal aA by the high-frequency component of the drive signal COMA.

The comparator 514 outputs the pulse-modulated modulation signal Ms based on the voltage signal As output from the adder 513. Specifically, the comparator 514 outputs the modulation signal Ms which is at H level when the voltage signal As output from the adder 513 is equal to or higher than a threshold Vth1 described later in a case where the voltage is rising, and is at L level when the voltage signal As falls below a threshold Vth2 described later in a case where the voltage is dropping. Here, the thresholds Vth1 and Vth2 are set in a relationship in which the threshold Vth1 is greater than the threshold Vth2. The frequency and the duty ratio of the modulation signal Ms change in accordance with the base drive signals dA and aA. Therefore, the attenuator 517 adjusts the modulation gain corresponding to the sensitivity, so that the change amount of the frequency or the duty ratio of the modulation signal Ms can be adjusted.

The modulation signal Ms output from the comparator 514 is supplied to a gate driver 521 included in the gate drive circuit 520. The modulation signal Ms is also supplied to a gate driver 522 included in the gate drive circuit 520 after the logic level is inverted by the inverter 515. That is, the logic levels of the signals supplied to the gate driver 521 and the gate driver 522 are mutually exclusive.

Here, the timing may be controlled so that the logic levels of the signals supplied to the gate driver 521 and the gate driver 522 are not H level at the same time. In other words, "exclusive" here means that the logic levels of the signals supplied to the gate driver 521 and the gate driver 522 are not H level at the same time. For details, this means that the transistor M1 and the transistor M2 included in the amplifier circuit 550 are not turned on at the same time.

The modulation signal is, in a narrow sense, the modulation signal Ms, but assuming that the signal is pulse-modulated according to the analog base drive signal aA based on the digital base drive signal dA, a signal in which the logical level of the modulation signal Ms is inverted is also included in the modulation signal. That is, the modulation signal output from the modulation circuit 510 includes not only the modulation signal Ms input to the gate driver 521, but also a signal in which the logic level of the modulation signal Ms input to the gate driver 522 is inverted, and a signal whose timing is controlled with respect to the modulation signal Ms.

The gate drive circuit 520 includes the gate driver 521 and the gate driver 522.

The gate driver 521 shifts the level of the modulation signal Ms output from the comparator 514 to output the level-shifted modulation signal Ms as a first amplification control signal from the terminal Hdr. The higher side of the power supply voltage of the gate driver 521 is a voltage applied via the terminal Bst, and the lower side is a voltage applied via the terminal Sw. The terminal Bst is coupled to one end of a capacitor C5 and the cathode of a diode D1 for backflow prevention. The terminal Sw is coupled to the other end of the capacitor C5. The anode of the diode D1 is coupled to the terminal Gvd. As a result, a voltage Vm which is a DC voltage of, for example, 7.5 V supplied from a power supply circuit (not shown) is supplied to the anode of the diode D1. Therefore, the potential difference between the terminal Bst and the terminal Sw is approximately equal to the potential difference between both ends of the capacitor C5, that is, the voltage Vm. The gate driver 521 outputs, from the terminal Hdr, the first amplification control signal having a voltage higher than, by the voltage Vm, that of the terminal Sw according to the input modulation signal Ms.

The gate driver 522 operates at a lower potential than the gate driver 521. The gate driver 522 shifts the level of the signal obtained by inverting, by the inverter 515, the logical level of the modulation signal Ms output from the comparator 514 to output the level-shifted signal from the terminal Ldr as a second amplification control signal. The voltage Vm is applied to the higher side of the power supply voltage of the gate driver 522, and the ground potential of, for example, 0 V is supplied to the lower side via the terminal Gnd. The second amplification control signal having a voltage higher than, by the voltage Vm, that of the terminal Gnd according to the signal input to the gate driver 522 is output from the terminal Ldr.

The reference voltage generation circuit 530 generates the reference voltage signal VBS supplied to the electrode 612 of the piezoelectric element 60 to output the generated reference voltage signal VBS to the electrode 612 of the piezoelectric element 60 via the terminal Vbs of the integrated circuit 500 and a terminal VBS-Out of the drive signal output circuit 51*a*. The reference voltage generation circuit 530 is configured by a constant voltage circuit including a band gap reference circuit, for example. Here, the reference voltage generation circuit 530 that outputs the reference voltage signal VBS is an example of the constant voltage output circuit.

Here, in FIG. 10, the reference voltage generation circuit 530 is described as being included in the integrated circuit 500 included in the drive signal output circuit 51*a*, but the reference voltage generation circuit 530 may be configured outside the integrated circuit 500, or may be configured outside the drive signal output circuit 51*a*.

The output circuit 580 includes the amplifier circuit 550 and a smoothing circuit 560. The amplifier circuit 550 also includes the transistor M1 and the transistor M2. The drain of the transistor M1 is electrically coupled to a terminal Hd. The voltage VHV is supplied to the drain of the transistor M1 via a terminal VHV-In. The gate of the transistor M1 is electrically coupled to one end of a resistor R1, and the other end of the resistor R1 is electrically coupled to the terminal Hdr of the integrated circuit 500. That is, the first amplification control signal output from the terminal Hdr of the integrated circuit 500 is supplied to the gate of the transistor M1. The source of the transistor M1 is electrically coupled to the terminal Sw of the integrated circuit 500.

The drain of the transistor M2 is electrically coupled to the terminal Sw of the integrated circuit 500. That is, the drain of the transistor M2 and the source of the transistor M1 are electrically coupled to each other. The gate of the transistor M2 is electrically coupled to one end of a resistor R2, and the other end of the resistor R2 is electrically coupled to the terminal Ldr of the integrated circuit 500. That is, the second amplification control signal output from the terminal Ldr of the integrated circuit 500 is supplied to the gate of the transistor M2. The ground potential is supplied to the source of the transistor M2.

In the amplifier circuit 550 configured as described above, when the transistor M1 is turned off and the transistor M2 is turned on, the voltage of the node to which the terminal Sw is coupled is the ground potential. Therefore, the voltage Vm is supplied to the terminal Bst. On the other hand, when the transistor M1 is turned on and the transistor M2 is turned off, the voltage of the node to which the terminal Sw is coupled is the voltage VHV. Therefore, a voltage signal of the potential of the voltage VHV+Vm is supplied to the terminal Bst.

That is, the gate driver 521 that drives the transistor M1 uses the capacitor C5 as a floating power supply, and when the potential of the terminal Sw changes to 0 V or the voltage VHV according to the operation of the transistor M1 and the transistor M2, supplies, to the gate of the transistor M1, the first amplification control signal whose L level is the potential of the voltage VHV and whose H level is the potential of the voltage VHV+the voltage Vm.

On the other hand, the gate driver 522 that drives the transistor M2 supplies, to the gate of the transistor M2, the second amplification control signal whose L level is the ground potential and whose H level is the potential of the voltage Vm irrespective of the operations of the transistor M1 and the transistor M2.

As described above, the amplifier circuit 550 amplifies, by the transistor M1 and the transistor M2 based on the voltage VHV, the modulation signal Ms obtained by modulating the base drive signals dA and aA. As a result, an amplified modulation signal is generated at the coupling point where the source of the transistor M1 and the drain of the transistor M2 are commonly coupled. Then, the amplified modulation signal generated by the amplifier circuit 550 is input to the smoothing circuit 560. Here, the voltage VHV is an example of the amplified voltage signal.

The smoothing circuit 560 generates the drive signal COMA by smoothing the amplified modulation signal output from the amplifier circuit 550 to output the generated drive signal COMA from the drive signal output circuit 51*a*. The smoothing circuit 560 includes a coil L1 and a capacitor C1.

The amplified modulation signal output from the amplifier circuit 550 is input to one end of the coil L1. The other end of the coil L1 is coupled to the terminal COMA-Out serving as an output of the drive signal output circuit 51*a*. That is, the drive signal output circuit 51*a* is coupled to each of the selection circuits 230 included in the respective print heads 20 via the terminal COMA-Out. As a result, the drive signal COMA output from the drive signal output circuit 51*a* is supplied to the selection circuit 230. The other end of the coil L1 is also coupled to one end of the capacitor C1. The ground potential is supplied to the other end of the capacitor C1. That is, the coil L1 and the capacitor C1 demodulates the amplified modulation signal by smooths the amplified modulation signal output from the amplifier circuit 550, and output the demodulated signal as the drive signal COMA.

The first feedback circuit 570 includes a resistor R3 and a resistor R4. One end of the resistor R3 is coupled to the terminal COMA-Out through which the drive signal COMA is output, and the other end is coupled to the terminal Vfb and one end of the resistor R4. The voltage VHV is supplied to the other end of the resistor R4 via the terminal VHV-In. As a result, the drive signal COMA that has passed through the first feedback circuit 570 from the terminal COMA-Out is fed back to the terminal Vfb in a state of being pulled up by the voltage VHV.

The second feedback circuit 572 includes capacitors C2, C3, and C4 and resistors R5 and R6. One end of the capacitor C2 is coupled to the terminal COMA-Out through which the drive signal COMA is output, and the other end is coupled to one end of the resistor R5 and one end of the resistor R6. The ground potential is supplied to the other end of the resistor R5. Thus, the capacitor C2 and the resistor R5 function as a high pass filter. The cut-off frequency of the high-pass filter is set to, for example, about 9 MHz. The other end of the resistor R6 is coupled to one end of the capacitor C4 and one end of the capacitor C3. The ground potential is supplied to the other end of the capacitor C3. Thus, the resistor R6 and the capacitor C3 function as a low pass filter. The cutoff frequency of the LPF is set to, for example, about 160 MHz. In this way, since the second feedback circuit 572 includes the high-pass filter and the low-pass filter, so that the second feedback circuit 572 functions as a band pass filter that passes a predetermined frequency range of the drive signal COMA.

The other end of the capacitor C4 is coupled to the terminal Ifb of the integrated circuit 500. As a result, a signal obtained by cutting the DC component out of the high frequency components of the drive signal COMA that has passed through the second feedback circuit 572 that functions as the band pass filter is fed back to the terminal Ifb.

The drive signal COMA output from the terminal COMA-Out is a signal obtained by smoothing the amplified modulation signal by the smoothing circuit 560. The drive signal COMA is integrated/subtracted via the terminal Vfb, and then fed back to the adder 512. Therefore, the drive signal output circuit 51*a* self-oscillates at a frequency determined by the feedback delay and the feedback transfer function.

However, since the feedback path via the terminal Vfb has a large delay amount, so that there is a case where the frequency of the self-oscillation cannot be made high enough to ensure the accuracy of the drive signal COMA simply by the feedback via the terminal Vfb. Therefore, the delay in the entire circuit is reduced by providing a path for feeding back the high-frequency component of the drive signal COMA via the terminal Ifb separately from the path via the terminal Vfb. As a result, the frequency of the voltage signal As can be made high enough to ensure the accuracy of the drive signal COMA as compared with the case where there is no path via the terminal Ifb.

Figure 11:
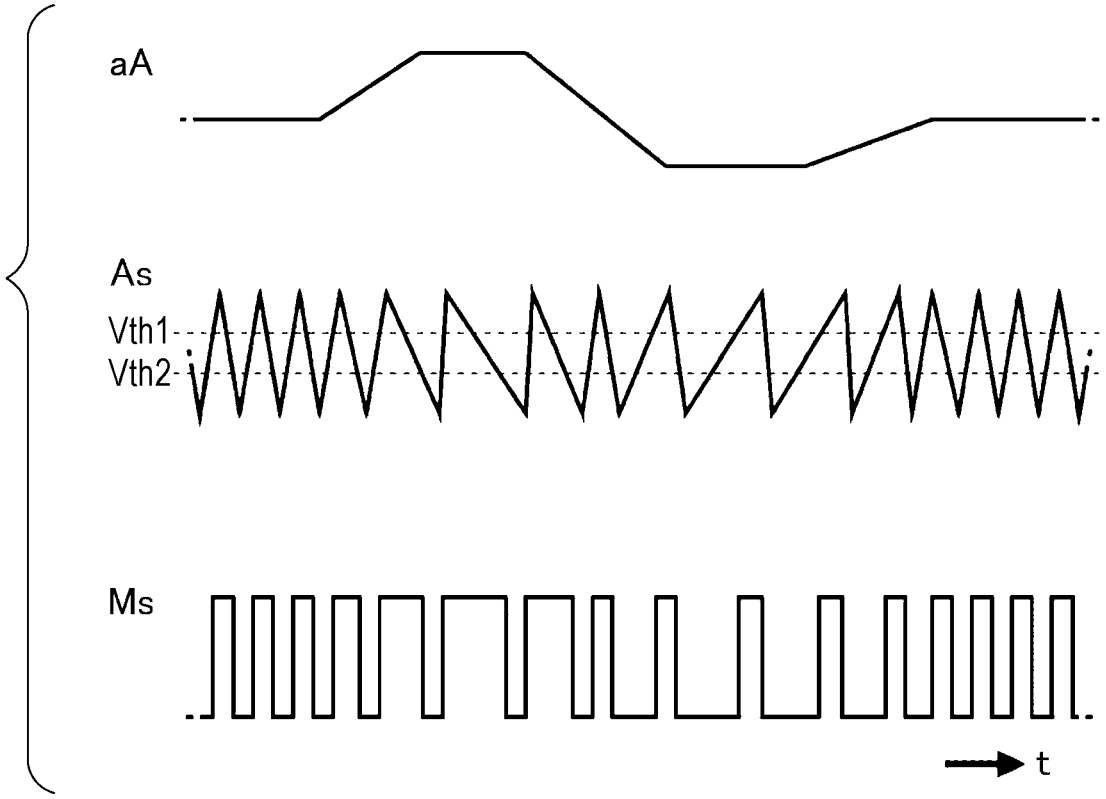
FIG. 11 is a diagram illustrating the waveforms of a voltage signal As and a modulation signal Ms in association with the waveform of an analog base drive signal aA.

FIG. 11 is a diagram illustrating the waveforms of the voltage signal As and the modulation signal Ms in association with the waveform of the analog base drive signal aA.

As shown in FIG. 11, the voltage signal As is a triangular wave, and its oscillation frequency varies according to the voltage of the base drive signal aA. Specifically, the frequency is highest when the voltage of the base drive signal aA has an intermediate value, and decreases as the voltage of the base drive signal aA has a value higher or lower than the intermediate value.

Further, the slope of the triangular wave of the voltage signal As at the rise of the voltage is almost equal to that at the fall of the voltage when the voltage has the nearly intermediate value. Therefore, the duty ratio of the modulation signal Ms obtained by comparing the voltage signal As with the thresholds Vth1 and Vth2 of the comparator 514 is approximately 50%. When the voltage of the base drive signal aA increases from the intermediate value, the downward slope of the voltage signal As is gentle. Therefore, the period during which the modulation signal Ms is at H level is relatively long, and the duty ratio of the modulation signal Ms increases. On the other hand, when the voltage of the base drive signal aA decreases from the intermediate value, the upward slope of the voltage signal As decreases. Therefore, the period during which the modulation signal Ms is at H level is relatively short, and the duty ratio of the modulation signal Ms decreases.

The gate driver 521 turns on or off the transistor M1 based on the modulation signal Ms. That is, the gate driver 521 turns on the transistor M1 when the modulation signal Ms is at H level, and turns off the transistor M1 when the modulation signal Ms is at L level. The gate driver 522 turns on or off the transistor M2 based on the logically inverted signal of the modulation signal Ms. That is, the gate driver 522 turns off the transistor M2 when the modulation signal Ms is at H level and turns on the transistor M2 when the modulation signal Ms is at L level.

Therefore, the voltage value of the drive signal COMA obtained by smoothing the amplified modulation signal output from the amplifier circuit 550 by the smoothing circuit 560 increases as the duty ratio of the modulation signal Ms increases, and decreases as the duty ratio decreases. That is, the control is performed so that the waveform of the drive signal COMA matches the waveform obtained by enlarging the voltage of the base drive signal aA obtained by performing the analog conversion on the digital base drive signal dA.

Further, since the drive signal output circuit 51*a* uses the pulse density modulation, there is also an advantage that the change width of the duty ratio can be made large as compared with that of the pulse width modulation with a fixed modulation frequency. The minimum positive pulse width and the minimum negative pulse width that can be used in the drive signal output circuit 51*a* are limited by circuit characteristics. Therefore, in the pulse width modulation in which the frequency is fixed, the change width of the duty ratio is limited within a predetermined range. In contrast, with the pulse density modulation, as the voltage of the voltage signal As moves away from the intermediate value, the oscillation frequency decreases, and as a result, it is possible to further increase the duty ratio in a region where the voltage is high. Further, it is possible to further decrease the duty ratio in a region where the voltage is low. Therefore, it is possible to secure a wider range of the change width of the duty ratio by employing self-oscillation type pulse density modulation.

As described above, the drive signal output circuit 51*a* modulates the base drive signal dA input from the terminal dA-In in the integrated circuit 500. The output circuit 580 amplifies and demodulates, based on the voltage VHV input from the terminal VHV-In, a signal based on the base drive signal dA output from the integrated circuit 500 to generate the drive signal COMA and output it via the terminal COMA-Out.

Here, the drive signal COMA output by the drive signal output circuit 51*a* is selected or deselected by the selection circuit 230 to be supplied, as the drive signal VOUT supplied to the electrode 611 of the piezoelectric element 60, to the piezoelectric element 60. That is, the output current based on the drive signal COMA output by the drive signal output circuit 51*a* changes according to the number of the piezoelectric elements 60 supplied as the drive signal VOUT. Then, the output current of the drive signal output circuit 51*a* changes, so that the voltage value of the voltage VHV input to the drive signal output circuit 51*a* may fluctuate. As a result, the waveform accuracy of the drive signal COMA generated by amplification based on the voltage VHV may decrease.

Therefore, as shown in FIG. 10, a capacitor C6 for reducing the voltage fluctuation of the voltage VHV when the output current of the drive signal output circuit 51*a* changes is electrically coupled to the terminal VHV-In. The capacitor C6 is required to have a relatively large capacitance for reducing the voltage fluctuation of the voltage VHV with respect to the change in the output current, and to have a withstand voltage equal to or higher than the voltage value of the voltage VHV. Therefore, an electrolytic capacitor having a relatively large capacitance and a withstand voltage of several tens of volts or more is used for the capacitor C6. As a result, it is possible to reduce the possibility that the voltage value of the voltage VHV fluctuates in response to the change in the output current of the drive signal output circuit 51*a*.

Further, the reference voltage generation circuit 530 included in the integrated circuit 500 generates the reference voltage signal VBS supplied to the electrode 612 of the piezoelectric element 60 to output the generated reference voltage signal VBS via the terminal VBS-Out. The current value output from the drive signal output circuit 51*a* based on the reference voltage signal VBS changes according to the number of piezoelectric elements 60 to which the drive signal COMA as the drive signal VOUT is supplied. Therefore, the voltage value of the reference voltage signal VBS may fluctuate, and when the voltage value of the reference voltage signal VBS fluctuate, the potential difference between the electrode 611 and the electrode 612 of the piezoelectric element 60 may vary. Therefore, the driving of the piezoelectric element 60 may vary, and as a result, the accuracy of ink ejection may decrease.

For this reason, as shown in FIG. 10, a capacitor C7 for reducing the voltage fluctuation of the reference voltage signal VBS when the current value output from the drive signal output circuit 51*a* based on the reference voltage signal VBS changes is electrically coupled to the terminal VBS-Out. The capacitor C7 is required to have a relatively large capacitance for reducing the voltage fluctuation of the reference voltage signal VBS with respect to the change in the output current, and to have a withstand voltage equal to or higher than the voltage value of the reference voltage signal VBS. Therefore, an electrolytic capacitor having a relatively large capacitance and a withstand voltage of several volts or more is used for the capacitor C7. As a result, it is possible to reduce the possibility that the voltage value of the reference voltage signal VBS fluctuates with respect to the change in the current value output from the drive signal output circuit 51*a* based on the reference voltage signal VBS.

6. Configurations of Drive Circuit Substrate and Drive Signal Output Circuit Substrate Next, with reference to FIGS. 12 to 15, configurations of a drive signal output circuit substrate 40*a* on which the drive signal output circuit 51*a* that outputs the drive signal COMA is mounted, a drive signal output circuit substrate 40*b* on which the drive signal output circuit 51*b* that outputs the drive signal COMB is mounted, and a drive circuit substrate 30 to which the drive signal output circuit substrates 40*a* and 40*b* are detachably coupled will be described. In addition, in FIGS. 12 to 15, the capacitor C6 electrically coupled to the terminal VHV-In of the drive signal output circuit 51*a* is shown as a capacitor C6*a*, and the capacitor C7 electrically coupled to the terminal VBS-Out of the drive signal output circuit 51*a* is shown as a capacitor C7*a*. Similarly, the capacitor C6 electrically coupled to the terminal VHV-In of the drive signal output circuit 51*b* is shown as a capacitor C6*b*, and the capacitor C7 electrically coupled to the terminal VBS-Out of the drive signal output circuit 51*b* is shown as a capacitor C7*b*.

Figure 12:
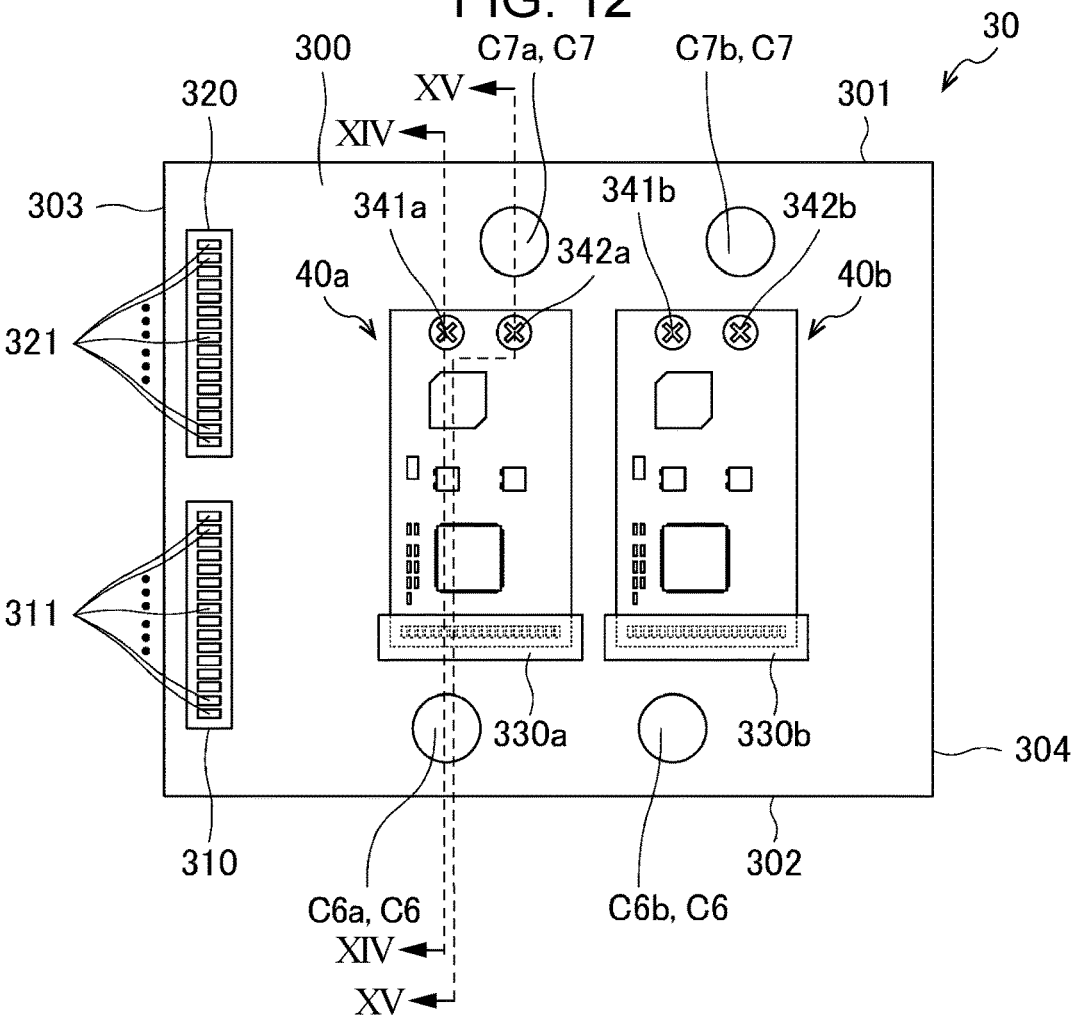
FIG. 12 is a plan view illustrating a configuration of a drive circuit substrate.

FIG. 12 is a plan view illustrating the configuration of the drive circuit substrate 30. As shown in FIG. 12, the drive circuit substrate 30 includes a substrate 300, connectors 310, 320, 330*a* and 330*b*, and capacitors C6*a*, C6*b*, C7*a*, and C7*b*.

The substrate 300 has a substantially rectangular shape including a side 301, a side 302 facing the side 301, a side 303 intersecting the side 301 and the side 302, and a side 304 that faces the side 303, and that intersects the side 301 and the side 302. The substrate 300 is provided with connectors 310, 320, 330*a* and 330*b* and capacitors C6*a*, C6*b*, C7*a*, and C7*b*. The substrate 300 is an example of a first substrate.

The connector 310 includes a plurality of terminals 311 disposed side by side in the direction along the side 303. Various signals including the clock signal SCK, the print data signal SI, the latch signal LAT, the change signal CH, and the base drive signals dA and dB which are output by the control circuit 100 described above and the voltage VHV output by the voltage output circuit 110 are input to the connector 310. That is, the connector 310 is electrically coupled to the control unit 10.

Of the clock signal SCK, the print data signal SI, the latch signal LAT, the change signal CH, the base drive signals dA and dB, and the voltage VHV which are input to the connector 310, the base drive signal dA and the voltage VHV are supplied to the drive signal output circuit substrates 40*a*, and the base drive signal dB and the voltage VHV are supplied to the drive signal output circuit substrate 40*b*. That is, among the plurality of terminals 311 included in the connector 310, the terminal 311 through which the base drive signal dA is input is electrically coupled to the terminal dA-In included in the drive signal output circuit 51*a* mounted on the drive signal output circuit substrate 40*a*, the terminal 311 through which the base drive signal dB is input is electrically coupled to the terminal dB-In included in the drive signal output circuit 51*b* mounted on the drive signal output circuit substrate 40*b*, and the terminal 311 through which the voltage VHV is input is coupled to the terminal VHV-In included in the drive signal output circuit 51*a* mounted on the drive signal output circuit substrate 40*a* and the terminal VHV-In included in the drive signal output circuit 51*b* mounted on the drive signal output circuit substrate 40*b*.

The clock signal SCK, the print data signal SI, the latch signal LAT, and the change signal CH in addition to the base drive signals dA and dB, and the voltage VHV may be input to the drive signal output circuit substrates 40*a* and 40*b*.

Here, the connector 310 through which the voltage VHV is input is an example of a second coupling terminal, and in detail, among the plurality of terminals 311 included in the connector 310, the terminal 311 through which the voltage VHV is input is an example of the second coupling terminal.

The connector 320 is located toward the side 301 relative to the connector 310 and includes a plurality of terminals 321 disposed side by side in the direction along the side 303. The drive signal COMA output from the drive signal output circuit 51*a* mounted on the drive signal output circuit substrate 40*a*, the drive signal COMB output from the drive signal output circuit 51*b* mounted on the drive signal output circuit substrate 40*b*, and the reference voltage signal VBS are input to the connector 320. That is, among the plurality of terminals 321 included in the connector 320, the terminal 321 through which the drive signal COMA is input is electrically coupled to the terminal COMA-Out included in the drive signal output circuit 51*a* mounted on the drive signal output circuit substrate 40*a*, the terminal 321 through which the drive signal COMB is input is electrically coupled to the terminal COMB-Out included in the drive signal output circuit 51*b* mounted on the drive signal output circuit substrate 40*b*, and the terminal 321 through which the reference voltage signal VBS is input is electrically coupled to at least one of the terminal VBS-Out included in the drive signal output circuit 51*a* mounted on the drive signal output circuit substrate 40*a* and the terminal VBS-Out included in the drive signal output circuit 51*b* mounted on the drive signal output circuit substrate 40*b*.

Further, the clock signal SCK, the print data signal SI, the latch signal LAT, and the change signal CH are input to the connector 320. Various signals including the drive signals COMA and COMB, the reference voltage signal VBS, the clock signal SCK, the print data signal SI, the latch signal LAT, and the change signal CH which are input to the connector 320 are supplied to the print head 20. That is, the plurality of terminals 321 included in the connector 320 and the connector 320 is electrically coupled to the print head 20.

Here, the connector 320 electrically coupled to the print head 20 is an example of a first coupling terminal, and in detail, among the plurality of terminals 321 included in the connector 320, the terminal 321 through which the reference voltage signal VBS is input is an example of the first coupling terminal.

The capacitor C6*a* is provided toward the side 304 relative to the connector 310, and the capacitor C6*b* is provided toward the side 304 relative to the capacitor C6*a*. That is, the capacitors C6*a* and C6*b* are located toward the side 304 relative to the connector 310, and are provided side by side in this order of the capacitor C6*a* and the capacitor C6*b* in the direction from the side 303 to the side 304. The positive terminal which is one end of the capacitor C6*a* electrically couples the terminal 311 included in the connector 310 and the terminal VHV-In included in the drive signal output circuit substrate 40*a*, and is electrically coupled to wiring that is a propagation path through which the voltage VHV propagates. The ground potential is supplied to the negative terminal which is the other end of the capacitor C6*a*. That is, the capacitor C6*a* is electrically coupled to the terminal VHV-In included in the drive signal output circuit substrate 40*a* and the terminal 311 included in the connector 310.

Similarly, the positive terminal which is one end of the capacitor C6*b* electrically couples the terminal 311 included in the connector 310 and the terminal VHV-In included in the drive signal output circuit substrate 40*b*, and is electrically coupled to wiring that is a propagation path through which the voltage VHV propagates. The ground potential is supplied to the negative terminal which is the other end of the capacitor C6*b*. That is, the capacitor C6*b* is electrically coupled to the terminal VHV-In included in the drive signal output circuit substrate 40*b* and the terminal 311 included in the connector 310. Here, the capacitor C6*a* is an example of a second electrolytic capacitor, and the capacitor C6*b* is another example of the second electrolytic capacitor.

The capacitor C7*a* is located toward the side 304 relative to the connector 320, and is provided toward the side 301 relative to the capacitors C6*a* and C6*b*. The capacitor C7*b* is located toward the side 304 relative to the capacitor C7*a*, and is provided toward the side 301 relative to the capacitors C6*a* and C6*b*. That is, the capacitors C7*a* and C7*b* are located toward the side 304 relative to the connector 320 and toward the side 301 relative to the capacitors C6*a* and C6*b* provided side by side, and are disposed side by side in this order of the capacitor C7*a* and the capacitor C7*b* in the direction from the side 303 to the side 304. The positive terminal which is one end of the capacitor C7*a* electrically couples the terminal 321 included in the connector 320 and the terminal VBS-Out included in the drive signal output circuit substrate 40*a*, and is electrically coupled to wiring that is a propagation path through which the reference voltage signal VBS propagates. The ground potential is supplied to the negative terminal which is the other end of the capacitor C7*a*. That is, the capacitor C7*a* is electrically coupled to the terminal VBS-Out included in the drive signal output circuit substrate 40*a* and the terminal 321 included in the connector 320.

Similarly, the positive terminal which is one end of the capacitor C7*b* electrically couples the terminal 321 included in the connector 320 and the terminal VBS-Out included in the drive signal output circuit substrate 40*b*, and is electrically coupled to wiring that is a propagation path through which the reference voltage signal VBS propagates. The ground potential is supplied to the negative terminal which is the other end of the capacitor C7*b*. That is, the capacitor C7*b* is electrically coupled to the terminal VBS-Out included in the drive signal output circuit substrate 40*b* and the terminal 321 included in the connector 320. Here, the capacitor C7*a* is an example of a first electrolytic capacitor, and the capacitor C7*b* is another example of the first electrolytic capacitor.

The connector 330*a* is located toward the side 304 relative to the connector 310, and is provided between the capacitors C6*a* and C6*b* provided side by side and the capacitors C7*a* and C7*b* provided side by side. The connector 330*b* is located toward the side 304 relative to the connector 330*a*, and is provided between the capacitors C6*a* and C6*b* disposed side by side and the capacitors C7*a* and C7*b* provided side by side. That is, the connectors 330*a* and 330*b* are located toward the side 304 relative to the connector 310, and toward the side 301 relative to the capacitors C6*a* and C6*b* provided side by side and toward the side 302 relative to the capacitors C7*a* and C7*b* provided side by side, and are provided in the order of the connector 330*a* and the connector 330*b* from the side 303 toward the side 304.

Here, the description will be given assuming that the connector 330*a* in the present embodiment is a card edge connector electrically coupled to the drive signal output circuit substrate 40*a* by an insertion of the drive signal output circuit substrate 40*a* into the connector 330*a*, and similarly, the connector 330*b* is a card edge connector electrically coupled to the drive signal output circuit substrate 40*b* by an insertion of the drive signal output circuit substrate 40*b* into the connector 330*b*.

The drive signal output circuit substrate 40*a* is provided toward the side 301 relative to the connector 330*a*. One side of the drive signal output circuit substrate 40*a* located toward the side 302 relative to the drive circuit substrate 30 is inserted into the connector 330*a*. As a result, a terminal 410 of the drive signal output circuit substrate 40*a* shown in FIG. 13 and the connector 330*a* are electrically coupled. Further, screws 341*a* and 342*a* that attaches the drive signal output circuit substrate 40*a* to the drive circuit substrate 30 are attached along the other side, of the drive signal output circuit substrate 40*a*, located toward the side 301 relative to the drive circuit substrate 30. As a result, the drive signal output circuit substrate 40*a* is detachably attached to the drive circuit substrate 30 by the connector 330*a* provided on the drive circuit substrate 30 and the screws 341*a* and 342*a*, and is electrically coupled to the drive circuit substrate 30.

The drive signal output circuit substrate 40*b* is provided toward the side 301 relative to the connector 330*b*. One side of the drive signal output circuit substrate 40*b* located toward the side 302 relative to the drive circuit substrate 30 is inserted into the connector 330*b*. As a result, the terminal 410 of the drive signal output circuit substrate 40*b* shown in FIG. 13 and the connector 330*b* are electrically coupled. Screws 341*b* and 342*b* that fixes the drive signal output circuit substrate 40*a* and the drive circuit substrate 30 are attached along the other side of the drive signal output circuit substrate 40*b* located toward the side 301 relative to the drive circuit substrate 30. As a result, the drive signal output circuit substrate 40*b* is detachably attached to the drive circuit substrate 30 by the connector 330*b* provided on the drive circuit substrate 30 and the screws 341*b* and 342*b*, and is electrically coupled to the drive circuit substrate 30.

The method of attaching the drive circuit substrate 30 and the drive signal output circuit substrates 40*a* and 40*b* and the details of the electrical coupling will be described later.

As mentioned above, the drive circuit substrate 30 includes the plurality of terminals 321 included in the connector 320 electrically coupled to the print head 20, the plurality of terminals 311 included in the connector 310 through which the voltage VHV is input, the capacitors C6 and C7, and the substrate 300 on which the connector 320 and the capacitor C7 are provided. The drive circuit substrate 30 is an example of a first circuit substrate.

Figure 13:
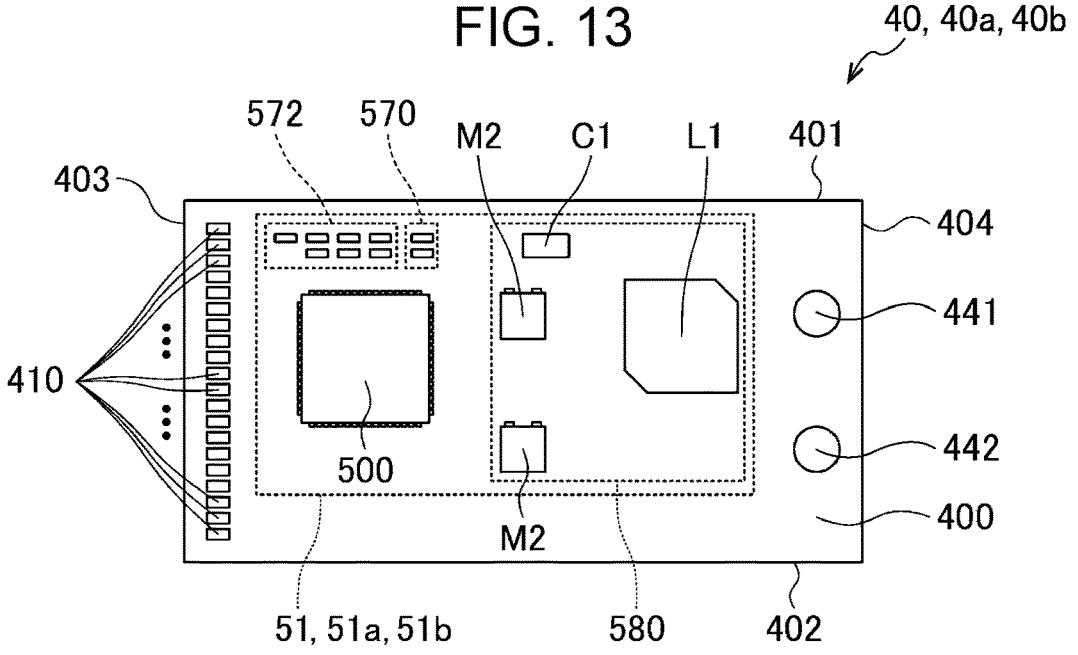
FIG. 13 is a plan view illustrating a configuration of a drive signal output circuit substrate.

Next, the configuration of the drive signal output circuit substrates 40*a* and 40*b* electrically coupled to the drive circuit substrate 30 will be described. FIG. 13 is a plan view illustrating the configuration of the drive signal output circuit substrates 40*a* and 40*b*. Here, the drive signal output circuit substrates 40*a* and 40*b* have the same configuration, and when the drive signal output circuit substrates 40*a* and 40*b* do not need to be particularly distinguished, they are simply referred to as a drive signal output circuit substrate 40. The drive signal output circuits 51*a* and 51*b* mounted on the drive signal output circuit substrate 40 are referred to as a drive signal output circuit 51, and the drive signals COMA and COMB output by the drive signal output circuit 51 are referred to as a drive signal COM.

The drive signal output circuit substrate 40 includes the drive signal output circuit 51 that outputs the drive signal COM for driving the piezoelectric element 60, the reference voltage generation circuit 530 that is included in the drive signal output circuit 51*a*, and which outputs the reference voltage signal VBS, the plurality of terminals 410 through which the base drive signal dA or the base drive signal dB, which is a basis of the drive signal COM, and the voltage VHV are input to the drive signal output circuit 51, and a substrate 400 on which the drive signal output circuit 51 and the plurality of terminals 410 are provided.

The substrate 400 has a substantially rectangular shape including a side 401, a side 402 facing the side 401, a side 403 that intersects the side 401 and the side 402, and a side 404 that faces the side 403, and that intersects the side 401 and the side 402. Then, as shown in FIG. 13, the side 401 and the side 402 of the substrate 400 are longer than the side 403 and the side 404. In other words, the substrate 400 includes the side 403 and the side 404, and the side 401 and the side 402 longer than the side 403 and the side 404. The substrate 400 is an example of a second substrate.

The plurality of terminals 410 provided on the substrate 400 is located side by side in the direction along the side 403 of the substrate 400. The plurality of terminals 410 is electrically coupled to the connector 330*a* or the connector 330*b* included in the drive circuit substrate 30. Then, the base drive signals dA and dB, and the voltage VHV are input to the drive signal output circuit substrate 40 via the plurality of terminals 410.

Here, among the plurality of terminals 410, the terminal 410 that is electrically coupled to the drive circuit substrate 30 via the connector 330*a* or the connector 330*b*, and through which the base drive signal dA that is a basis of the drive signal COMA or the base drive signal dB that is a basis of the drive signal COMB is input from the drive circuit substrate 30 is an example of a first input terminal. Further, as described above, the base drive signal dA is input to the drive signal output circuit 51*a* via the terminal dA-In included in the drive signal output circuit 51*a*. Therefore, the terminal 410 through which the base drive signal dA that is a basis of the drive signal COMA is input from the drive circuit substrate 30 is electrically coupled to the terminal dA-In included in the drive signal output circuit 51*a*. Similarly, the base drive signal dB is input to the drive signal output circuit 51*b* via the terminal dB-In included in the drive signal output circuit 51*b*. Therefore, the terminal 410 through which the base drive signal dB that is a basis of the drive signal COMB is input from the drive circuit substrate 30 is electrically coupled to the terminal dB-In included in the drive signal output circuit 51*b*. Therefore, the terminal dA-In included in the drive signal output circuit 51*a* and the terminal dB-In included in the drive signal output circuit 51*b* are also examples of the first input terminal. The base drive signal dA or the base drive signal dB is an example of a base drive signal.

Further, among the plurality of terminals 410, the terminal 410 that is electrically coupled to the drive circuit substrate 30 via the connector 330*a* or the connector 330*b*, and through which the voltage VHV is input from the drive circuit substrate 30 is an example of a second input terminal. As described above, the voltage VHV is input to the drive signal output circuit 51 via the terminal VHV-In included in the drive signal output circuit 51. Therefore, the terminal 410 through which the voltage VHV is input from the drive circuit substrate 30 is electrically coupled to the terminal VHV-In included in the drive signal output circuit 51. Therefore, the terminal VHV-In included in the drive signal output circuit 51 is also an example of the first input terminal.

The drive signal output circuit 51 is located toward the side 404 of the substrate 400 relative to the plurality of terminals 410 located side by side in the direction along the side 403. In other words, at least one of the plurality of terminals 410 and the drive signal output circuit 51 are located side by side in the direction along the side 401.

Specifically, as described above, the drive signal output circuit 51 includes the integrated circuit 500, the output circuit 580, the first feedback circuit 570, and the second feedback circuit 572. The integrated circuit 500 and the output circuit 580 are located toward the side 404 of the substrate 400 relative to the plurality of terminals 410 and are located side by side in the order of the integrated circuit 500 and the output circuit 580 along the direction from the side 403 to the side 404. In addition, the first feedback circuit 570 and the second feedback circuit 572 are located toward the side 404 of the substrate 400 relative to the plurality of terminals 410, and are located toward the side 401 relative to the integrated circuits 500 and the output circuit 580 located side by side in the direction along the side 401. Here, the integrated circuit 500 includes the reference voltage generation circuit 530 that outputs the reference voltage signal VBS as described above. That is, the reference voltage generation circuit 530 is also provided on the substrate 400.

In addition, the substrate 400 has insertion holes 441 and 442. The insertion holes 441 and 442 are located toward the side 404 relative to the drive signal output circuit 51, and are provided in the direction along the side 404 in the order of the insertion hole 441 and the insertion hole 442 along the direction from the side 401 to the side 402. The screw 341*a* or the screw 341*b* is inserted into the insertion hole 441, and the screw 342*a* or the screw 342*b* is inserted into the insertion hole 442. Then, each of the screws 341*a*, 341*b*, 342*a*, and 342*b* is fastened to the drive circuit substrate 30, so that the drive signal output circuit substrate 40 is attached to the drive circuit substrate 30.

In this case, as shown in FIGS. 12 and 13, the drive signal output circuit substrate 40 is attached to the drive circuit substrate 30 such that the side 401 is located toward the side 303 relative to the drive circuit substrate 30, the side 402 is located toward the side 304 relative to the drive circuit substrate 30, the side 403 is located toward the side 302 relative to the drive circuit substrate 30, the side 404 is located toward the side 301 relative to the drive circuit substrate 30. Specifically, the drive circuit substrate 30 and the drive signal output circuit substrates 40 are provided such that when viewed from a direction orthogonal to a face 305 which is one face of the substrate 300, at least part of the face 305 which is one face of the substrate 300 and a face 406 which is one face of the substrate 400 overlap with each other. That is, the drive circuit substrate 30 and the drive signal output circuit substrates 40*a* and 40*b* are located such that at least part of the face 305 of the substrate 300 and the face 406 of the substrate 400 face each other. When the side 403 of the drive signal output circuit substrate 40 is inserted into the connector 330*a* or the connector 330*b* provided on the drive circuit substrate 30, the plurality of terminals 410 disposed in parallel along the side 403 of the drive signal output circuit substrate 40, and the connector 330*a* or the connector 330*b* are electrically coupled.

Figure 14:
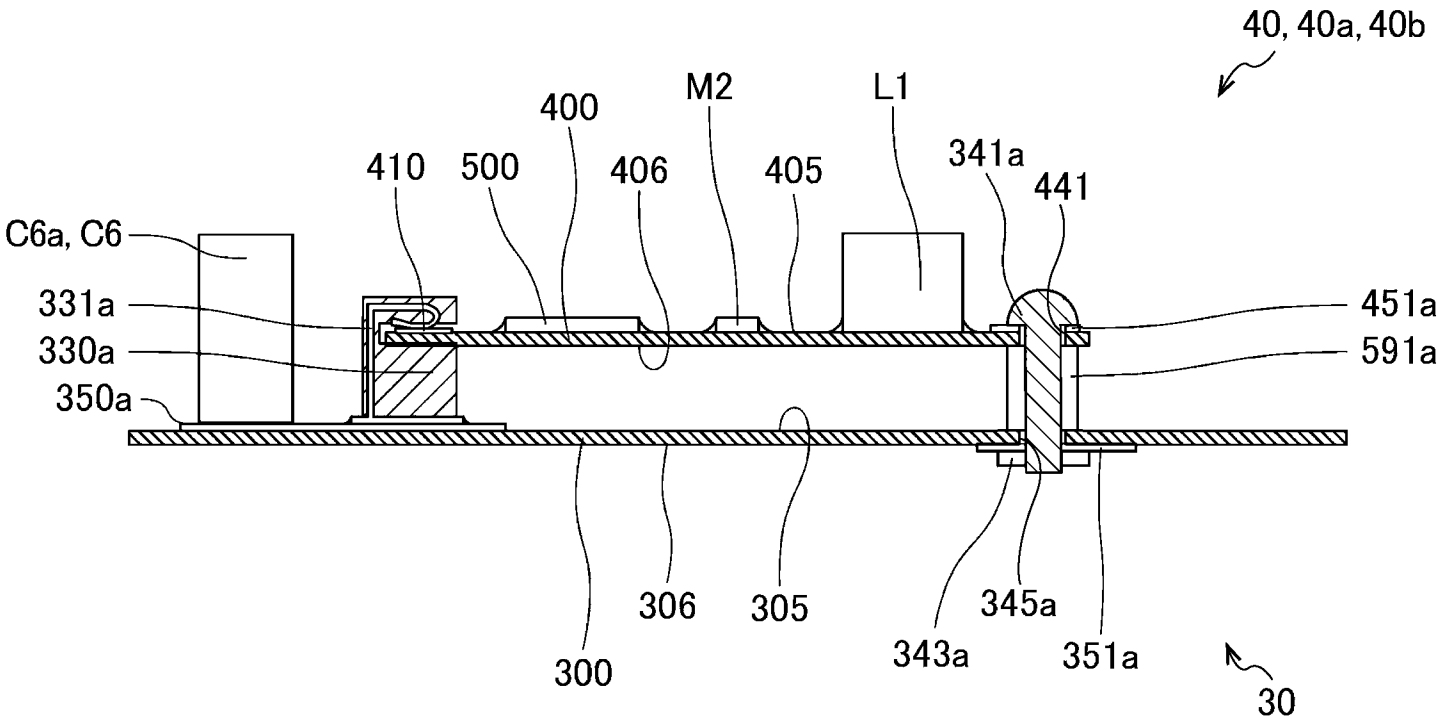
FIG. 14 is a diagram illustrating a cross section taken along line XIV-XIV of FIG. 12.
Figure 15:
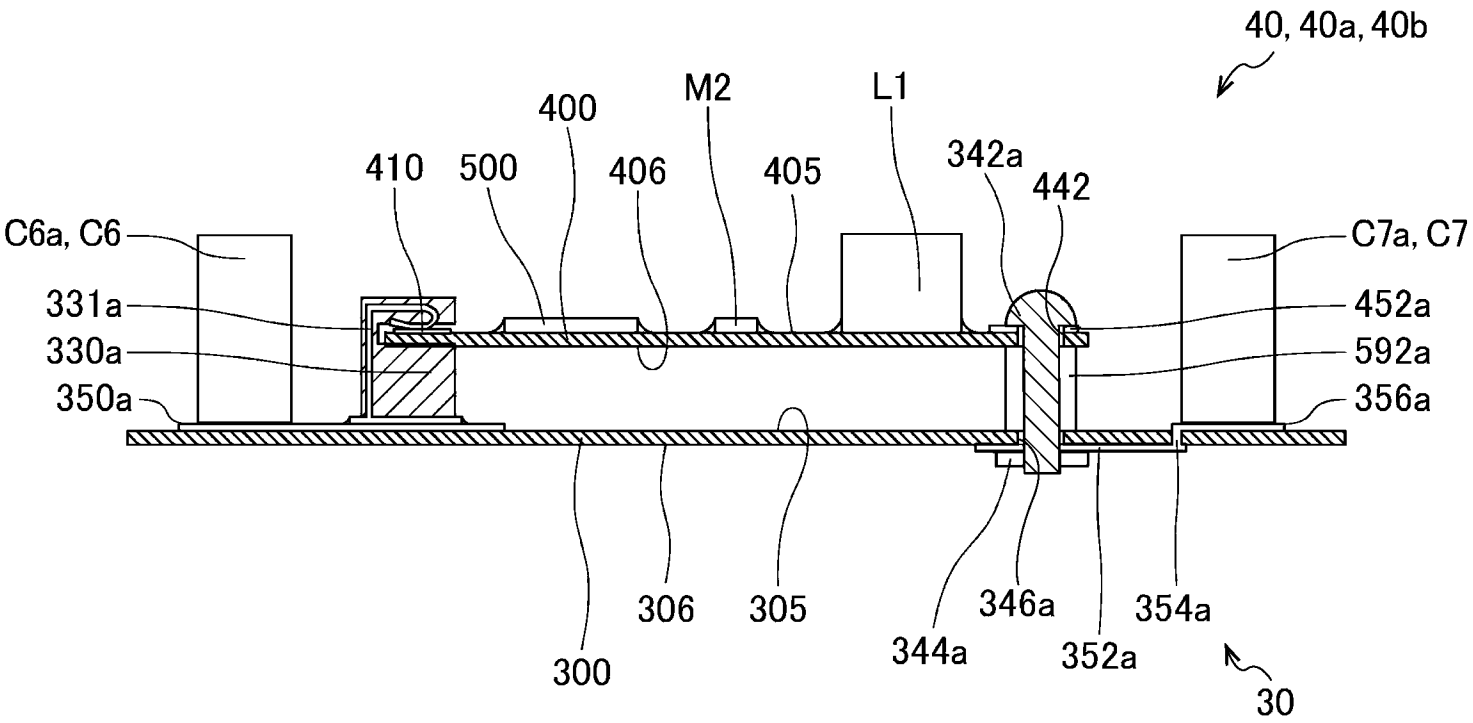
FIG. 15 is a diagram illustrating a cross section taken along line XV-XV of FIG. 12.

Next, a method of coupling the drive circuit substrate 30 and the drive signal output circuit substrates 40*a* and 40*b* will be described with reference to FIGS. 14 and 15. FIG. 14 is a diagram illustrating a cross section taken along line XIV-XIV of FIG. 12, and FIG. 15 is a diagram illustrating a cross section taken along line XV-XV of FIG. 12. The method of coupling the drive circuit substrate 30 and the drive signal output circuit substrate 40*a* is the same as the method of coupling the drive circuit substrate 30 and the drive signal output circuit substrate 40*b*. In FIGS. 14 and 15, while the coupling relationship between the drive circuit substrate 30 and the drive signal output circuit substrate 40*a* will be described, a description of the coupling relationship between the drive circuit substrate 30 and the drive signal output circuit substrate 40*b* will be omitted.

As shown in FIGS. 14 and 15, in the drive signal output circuit substrate 40*a*, a portion, of the substrate 400 toward the side 403, where the plurality of terminals 410 is located is inserted into the connector 330*a*. The connector 330*a* has a plurality of conductive portions 331*a* corresponding to the plurality of terminals 410. When the portion of the substrate 400 toward the side 401 is inserted into the connector 330*a*, each of the plurality of conductive portions 331*a* included in the connector 330*a*, and each of the plurality of terminals 410 provided on the substrate 400 are electrically coupled. As a result, various signals including the base drive signal dA propagating through the drive circuit substrate 30 and the voltage VHV are input to the drive signal output circuit substrate 40*a*.

Further, among the conductive portions 331*a* included in the connector 330*a*, the conductive portion 331*a* to which the voltage VHV is input is electrically coupled to a conductive portion 350*a* provided on the face 305 of the substrate 300 included in the drive circuit substrate 30. The conductive portion 350*a* is electrically coupled to the capacitor C6*a*. That is, the possibility that the voltage value of the voltage VHV input to the drive signal output circuit substrate 40*a* fluctuates is reduced by the capacitor C6*a* provided on the drive circuit substrate 30. The conductive portion 350*a* is electrically coupled to, among the plurality of terminals 311 included in the connector 310 included in the drive circuit substrate 30, the terminal 311 through which the voltage VHV is input.

The base drive signal dA input from the drive circuit substrate 30 to the drive signal output circuit substrate 40*a* via the connector 330*a* and the voltage VHV are input to the drive signal output circuit 51*a* via a propagation path (not shown) provided on the substrate 400. The drive signal output circuit 51*a* generates and outputs the drive signal COMA based on the input base drive signal dA and the input voltage VHV. The drive signal COMA output from the drive signal output circuit 51*a* propagates through a conductive portion 451*a* provided around the insertion hole 441.

The conductive portion 451*a* is electrically coupled to the screw 341*a* by inserting the screw 341*a* into the insertion hole 441. Further, the screw 341*a* inserted through the insertion hole 441 is inserted through a spacer 591*a* and an insertion hole 345*a* of the substrate 300, and is tightened by a nut 343*a* provided toward a face 306 of the substrate 300. As a result, the drive signal output circuit substrate 40*a* is fixed to the drive circuit substrate 30. Further, the screw 341*a* is tightened with the nut 343*a*, so that the nut 343*a* is electrically coupled to the conductive portion 351*a* provided on the face 306 of the substrate 300. That is, the drive signal COMA is output to the drive circuit substrate 30 via the conductive portion 451*a*, the screw 341*a*, and the nut 343*a*. In other words, the screw 341*a* serves as a fixing member that fixes the drive circuit substrate 30 and the drive signal output circuit substrate 40*a* and a propagation path through which the drive signal COMA is propagated to the drive circuit substrate 30.

Here, the conductive portion 451*a* that is electrically coupled to the drive circuit substrate 30 to output the drive signal COMA is an example of a first output terminal. Further, as described above, the drive signal COMA is output from the terminal COMA-Out. Therefore, the terminal COMA-Out included in the drive signal output circuit 51 is also an example of the first output terminal.

Further, as described above, the drive signal output circuit 51*a* provided on the drive signal output circuit substrate 40*a* also outputs the reference voltage signal VBS. As shown in FIG. 15, the reference voltage signal VBS output from the drive signal output circuit 51*a* propagates through a conductive portion 452*a* provided around the insertion hole 442.

The conductive portion 452*a* is electrically coupled to the screw 342*a* by inserting the screw 342*a* into the insertion hole 442. Further, the screw 342*a* inserted through the insertion hole 442 is inserted through a spacer 592*a* and an insertion hole 346*a* of the substrate 300, and is tightened by a nut 344*a* provided toward the face 306 of the substrate 300. As a result, the drive signal output circuit substrate 40*a* is fixed to the drive circuit substrate 30. Further, the screw 342*a* is tightened with the nut 344*a*, so that the nut 344*a* is electrically coupled to a conductive portion 352*a* provided on the face 306 of the substrate 300. That is, the reference voltage signal VBS is output to the drive circuit substrate 30 via the conductive portion 452*a*, the screw 342*a*, and the nut 344*a*. In other words, the screw 342*a* serves as a fixing member that fixes the drive circuit substrate 30 and the drive signal output circuit substrate 40*a*, and as a propagation path through which the reference voltage signal VBS is propagated to the drive circuit substrate 30.

The conductive portion 352*a* provided on the drive circuit substrate 30 is electrically coupled to a conductive portion 356*a* provided on the face 305 of the substrate 300 via an insertion conductor 354*a* inserted through the face 305 and the face 306 of the substrate 300. The conductive portion 356*a* is electrically coupled to the capacitor C7*a*. That is, the reference voltage signal VBS output from the drive signal output circuit substrate 40*a* is input to the capacitor C7*a*. This reduces the possibility that the voltage value of the reference voltage signal VBS output from the drive signal output circuit substrate 40*a* fluctuates.

Here, the conductive portion 452*a* that is electrically coupled to the drive circuit substrate 30 to output the reference voltage signal VBS is an example of a second output terminal. Further, as described above, the reference voltage signal VBS is output from the terminal VBS-Out. Therefore, the terminal VBS-Out included in the drive signal output circuit 51 is also an example of the second output terminal.

As mentioned above, the drive signal output circuit substrate 40*a* includes the drive signal output circuit 51*a* that outputs the drive signal COMA that is a basis of the drive signal VOUT supplied to the electrode 611 of the piezoelectric element 60, the reference voltage generation circuit 530 that outputs the reference voltage signal VBS supplied to the electrode 612 of the piezoelectric element 60, the conductive portion 451*a* electrically coupled to the drive circuit substrate 30 to output the drive signal COMA to the drive circuit substrate 30, the conductive portion 452*a* electrically coupled to the drive circuit substrate 30 to output the reference voltage signal VBS to the drive circuit substrate 30, the plurality of terminals 410 that is electrically coupled to the drive circuit substrate 30, and through which the base drive signal dA which is a basis of the drive signal COMA, and the voltage VHV are input from the drive circuit substrate 30, and the substrate 400 on which the drive signal output circuit 51*a*, the reference voltage generation circuit 530, the conductive portions 451*a* and 452*a*, and the plurality of terminals 410 are provided. The drive signal output circuit substrate 40*a* is an example of a second circuit substrate.

Although a detailed explanation is omitted here, as in the drive signal output circuit substrate 40*a*, the drive signal output circuit substrate 40*b* on which the drive signal output circuit 51*b* is mounted includes the drive signal output circuit 51*b* that outputs the drive signal COMB that is a basis of the drive signal VOUT supplied to the electrode 611 of the piezoelectric element 60, the reference voltage generation circuit 530 that outputs the reference voltage signal VBS supplied to the electrode 612 of the piezoelectric element 60, a conductive portion 451*b* that corresponds to the conductive portion 451*a* of the drive signal output circuit substrate 40*a*, land that outputs the drive signal COMA, a conductive portion 452*b* that corresponds the conductive portion 452*a* of the drive signal output circuit substrate 40*a*, and that outputs a reference voltage signal VBS, the plurality of terminals 410 that is electrically coupled to the drive circuit substrate 30, and through which the base drive signal dB which is a basis of the drive signal COMB, and the voltage VHV are input from the drive circuit substrate 30, and the substrate 400 on which the drive signal output circuit 51*b*, the reference voltage generation circuit 530, the conductive portions 451*b* and 452*b*, and the plurality of terminals 410 are provided. The drive signal output circuit substrate 40*b* is another example of the second circuit substrate, the conductive portion 451*b* electrically coupled to the drive circuit substrate 30 is another example of the first output terminal, and the conductive portion 452*b* electrically coupled to the drive circuit substrate 30 is another example of the second output terminal.

Here, as shown in FIGS. 12 to 15, the capacitor C6*a* for stabilizing the voltage value of the voltage VHV is provided on the substrate 300 toward a portion, of the substrate 400 toward the side 403, on which the terminal 410 through which the voltage VHV is input to the drive signal output circuit substrate 40*a* is provided. In other words, the shortest distance between the capacitor C6*a* and the terminal 410 included in the drive signal output circuit substrate 40*a* is shorter than the shortest distance between the capacitor C6*a* and the conductive portion 452*a* included in the drive signal output circuit substrate 40*a*.

As a result, the capacitor C6*a* makes it possible to shorten the wiring length of the wiring that is the propagation path through which the voltage VHV for which the possibility that the voltage value fluctuates is reduced propagates to the drive signal output circuit substrate 40*a*. As a result, the possibility that the voltage value of the voltage VHV input to the drive signal output circuit substrate 40*a* fluctuates is further reduced. Therefore, it is possible to further improve the accuracy of the drive signal COMA output from the drive signal output circuit substrate 40*a* and the drive circuit substrate 30.

Also, the capacitor C7*a* for stabilizing the voltage value of the reference voltage signal VBS is provided on the substrate 300 toward a portion, of the substrate 400 toward the side 404, on which the conductive portion 452*a* through which the reference voltage signal VBS is output from the drive signal output circuit substrate 40*a* is provided. In other words, the shortest distance between the capacitor C7*a* and the conductive portion 452*a* included in the drive signal output circuit substrate 40*a* is shorter than the shortest distance between the capacitor C7*a* and the terminal 410 included in the drive signal output circuit substrate 40*a*.

This makes it possible to shorten the wiring length of the wiring that is the propagation path through which the reference voltage signal VBS output from the drive signal output circuit substrate 40*a* is input to the capacitor C7*a*. As a result, the possibility that the voltage value of the reference voltage signal VBS fluctuates due to the impedance component of the propagation path through which the reference voltage signal VBS propagates is reduced. Furthermore, since the wiring length of the wiring that is the propagation path through which the reference voltage signal VBS propagates is shortened, the possibility of noise being superimposed on the propagation path is reduced, and as a result, it is possible to improve the accuracy of the voltage value of the reference voltage signal VBS. That is, the possibility that the voltage value of the reference voltage signal VBS output from the drive signal output circuit substrate 40*a* and the drive circuit substrate 30 fluctuates is reduced, and it is possible to improve the accuracy of the voltage value of the reference voltage signal VBS.

Similarly, the capacitor C6*b* for stabilizing the voltage value of the voltage VHV is provided on the substrate 300 toward a portion, of the substrate 400 toward the side 403, on which the terminal 410 through which the voltage VHV is input to the drive signal output circuit substrate 40*b* is provided. In other words, the shortest distance between the capacitor C6*b* and the terminal 410 included in the drive signal output circuit substrate 40*b* is shorter than the shortest distance between the capacitor C6*b* and the conductive portion 452*b* included in the drive signal output circuit substrate 40*b*.

As a result, the capacitor C6*b* makes it possible to shorten the wiring length of the wiring that is the propagation path through which the voltage VHV for which the possibility that the voltage value fluctuates is reduced propagates to the drive signal output circuit substrate 40*b*. As a result, the possibility that the voltage value of the voltage VHV input to the drive signal output circuit substrate 40*b* fluctuates is further reduced. Therefore, it is possible to further improve the accuracy of the drive signal COMB output from the drive signal output circuit substrate 40*b* and the drive circuit substrate 30.

Also, the capacitor C7*b* for stabilizing the voltage value of the reference voltage signal VBS is provided on the substrate 300 toward a portion, of the substrate 400 toward the side 404, on which the conductive portion 452*b* through which the reference voltage signal VBS is output from the drive signal output circuit substrate 40*b* is provided. In other words, the shortest distance between the capacitor C7*b* and the conductive portion 452*b* included in the drive signal output circuit substrate 40*b* is shorter than the shortest distance between the capacitor C7*b* and the terminal 410 included in the drive signal output circuit substrate 40*b*.

This makes it possible to shorten the wiring length of the wiring that is the propagation path through which the reference voltage signal VBS output from the drive signal output circuit substrate 40*b* is input to the capacitor C7*b*. As a result, the possibility that the voltage value of the reference voltage signal VBS fluctuates due to the impedance component of the propagation path through which the reference voltage signal VBS propagates is reduced. Furthermore, since the wiring length of the wiring that is the propagation path through which the reference voltage signal VBS propagates is shortened, the possibility of noise being superimposed on the propagation path is reduced, and as a result, it is possible to improve the accuracy of the voltage value of the reference voltage signal VBS. That is, the possibility that the voltage value of the reference voltage signal VBS output from the drive signal output circuit substrate 40*b* and the drive circuit substrate 30 fluctuates is reduced, and it is possible to improve the accuracy of the voltage value of the reference voltage signal VBS.

Here, the configuration including the drive signal output circuit substrates 40*a* and 40*b* and the drive circuit substrate 30 electrically coupled to the drive signal output circuit substrates 40*a* and 40*b* corresponds to the drive circuit 50 shown in FIG. 2.

7. Functions and Effects

The liquid ejecting apparatus 1 and the drive circuit 50 according to the present embodiment configured as described above include the drive circuit substrate 30 electrically coupled to the print head 20, and the drive signal output circuit substrates 40*a* and 40*b* electrically coupled to the drive circuit substrate 30.

The drive signal output circuit substrate 40*a* outputs, from the conductive portion 451*a*, the drive signal COMA which is a basis of the drive signal VOUT supplied to the electrode 611 of the piezoelectric element 60, the drive signal output circuit substrate 40*b* outputs, from the conductive portion 451*b*, the drive signal COMB which is a basis of the drive signal VOUT supplied to the electrode 611 of the piezoelectric element 60, and the drive signal output circuit substrates 40*a* and 40*b* output, from the conductive portion 452*a*, the reference voltage signal VBS having a constant voltage value supplied to the electrode 612 of the piezoelectric element 60. The piezoelectric element 60 is driven by the potential difference between the drive signal VOUT supplied to the electrode 611 and the reference voltage signal VBS supplied to the electrode 612. That is, the piezoelectric element 60 is driven according to the potential of the drive signal VOUT supplied to the electrode 611, with the voltage value of the reference voltage signal VBS having a constant voltage value supplied to the electrode 612 as a reference potential.

Further, the drive circuit substrate 30 includes the connector 320 electrically coupled to the print head 20, the capacitor C7*a* electrically coupled to the connector 320 and the conductive portion 452*a*, and the capacitor C7*b* electrically coupled to the connector 320 and the conductive portion 452*b*. That is, the capacitor C7*a* is provided in the path through which the reference voltage signal VBS output from the drive signal output circuit substrate 40*a* is propagated, and the capacitor C7*b* is provided in the path through which the reference voltage signal VBS output from the drive signal output circuit substrate 40*b* is propagated.

Each of the capacitors C7*a* and C7*b* is a capacitive element for reducing the possibility that the voltage value of the reference voltage signal VBS output from the drive signal output circuit substrates 40*a* and 40*b* fluctuates, and is composed of an electrolytic capacitor that can provide a sufficiently large capacitance. Therefore, the component size of each of the capacitors C7*a* and C7*b* is larger than that of the chip capacitors or the like. Since the capacitors C7*a* and C7*b*, which are electrolytic capacitors having such a large component size, are mounted on the drive circuit substrate 30, it is possible to reduce the sizes of the drive signal output circuit substrate 40*a* on which the drive signal output circuit 51*a* that outputs the drive signal COMA is mounted, and the drive signal output circuit substrate 40*b* on which the drive signal output circuit 51*b* that outputs the drive signal COMB is mounted, and the possibility that the replacement work when the drive signal output circuit substrate 40*a* or the drive signal output circuit substrate 40*b* is replaced is complicated can be reduced.

Further, in the liquid ejecting apparatus 1 and the drive circuit 50 according to the present embodiment, the capacitors C7*a* and C7*b* provided on the path through which the reference voltage signal VBS propagates are provided on the drive circuit substrate 30, so that it is possible to reduce the possibility that the voltage value of the reference voltage signal VBS supplied to the electrode 612 of the piezoelectric element 60 fluctuate, and as a result, the driving accuracy of the piezoelectric element 60 is improved. Therefore, the ejection accuracy of the ink ejected by driving the piezoelectric element 60 is improved.

Further, in the liquid ejecting apparatus 1 according to the present embodiment, the drive signal output circuit 51*a* provided on the drive signal output circuit substrate 40*a* amplifies a signal based on the base drive signal dA based on the voltage VHV to output the drive signal COMA, and the drive signal output circuit 51*b* provided on the drive signal output circuit substrate 40*b* amplifies a signal based on the base drive signal dB based on the voltage VHV to output the drive signal COMB. The drive circuit substrate 30 includes the capacitor C6*a* provided on the path through which the voltage VHV input from the connector 310 is propagated to the drive signal output circuit substrate 40*a*, and the capacitor C6*b* provided on the path through which the voltage VHV input from the connector 310 is propagated to the drive signal output circuit substrate 40*b*.

Each of the capacitors C6*a* and C6*b* is a capacitive element for reducing the possibility that the voltage value of the amplification voltage VHV that generates the drive signals COMA and COMB output from each of the drive signal output circuit substrates 40*a* and 40*b* fluctuates, and is composed of an electrolytic capacitor that can provide a sufficiently large capacitance. Therefore, the component size of each of the capacitors C6*a* and C6*b* is larger than that of the chip capacitors of the like. Since the capacitors C6*a* and C6*b*, which are electrolytic capacitors having such a large component size, are mounted on the drive circuit substrate 30, it is possible to reduce the sizes of the drive signal output circuit substrate 40*a* on which the drive signal output circuit 51*a* that outputs the drive signal COMA is mounted, and the drive signal output circuit substrate 40*b* on which the drive signal output circuit 51*b* that outputs the drive signal COMB is mounted, and the possibility that the replacement work when the drive signal output circuit substrate 40*a* or the drive signal output circuit substrate 40*b* is replaced is complicated can be reduced.

Further, in the liquid ejecting apparatus 1 and the drive circuit 50 according to the present embodiment, the capacitors C6*a* and C6*b* provided on the path through which the voltage VHV propagates are provided on the drive circuit substrate 30, so that it is possible to stabilize the voltage value of the voltage VHV which is an amplified voltage for the drive signal output circuits 51*a* and 51*b* to generate the drive signals COMA and COMB. As a result, the waveform accuracy of the drive signals COMA and COMB output by the drive signal output circuits 51*a* and 51*b* is improved. Therefore, the ejection accuracy of the ink ejected by driving the piezoelectric element 60 is improved.

As mentioned above, in the liquid ejecting apparatus 1 and the drive circuit 50 according to the present embodiment, it is possible to downsize the drive signal output circuit substrate 40*a* including the drive signal output circuit 51*a* that outputs the drive signal COMA and the drive signal output circuit substrate 40*b* including the drive signal output circuit 51*b* that outputs the drive signal COMB, and it is possible to improve the driving accuracy of the piezoelectric element 60.

8. Modification

In the liquid ejecting apparatus 1 described above, description is made in which the method of fixing the drive signal output circuit substrate 40*a*, 40*b*, 40 to the drive circuit substrate 30 includes using the screw, but the method is not limited to this. That is, the method of fixing the drive signal output circuit substrates 40*a*, 40*b*, 40 to the drive circuit substrate 30 may include using a conductive member that can fix the drive signal output circuit substrates 40*a*, 40*b*, 40 to the drive circuit substrate 30, and for example, may include using a leaf spring.

Further, in the liquid ejecting apparatus 1 described above, the description is made in which the drive signal output circuit 51*a* that outputs the drive signal COMA and the drive signal output circuit 51*b* that outputs the drive signal COMB are mounted on different substrates 400, but the drive signal output circuit 51 *a* that outputs the drive signal COMA and the drive signal output circuit 51*b* that outputs the drive signal COMB may be mounted on one substrate 400.

The embodiments and the modifications have been described above, but the present disclosure is not limited to these embodiments and modifications. It is possible to implement the present disclosure in various aspects without departing from the gist thereof, and for example, the embodiments and the modifications can be combined appropriately.

The disclosure includes a configuration substantially same as the configuration described in the embodiments and the modifications (for example, a configuration having the same function, method, and result, or a configuration having the same object and effect). Further, the disclosure includes a configuration in which a non-essential part of the configuration described in the embodiments and the modifications is replaced. Further, the disclosure includes a configuration having the same functions and effects as the configuration described in the embodiments and the modifications or a configuration capable of achieving the same object. Further, the disclosure includes a configurations in which known techniques are added to the configurations described in the embodiments and the modifications.

What is claimed is:

1. A liquid ejecting apparatus comprising:

a print head that includes a first terminal and a second terminal, the print head including a drive element that is driven by a potential difference between the first terminal and the second terminal, the print head ejecting a liquid by driving the drive element;

a first circuit substrate electrically coupled to the print head; and a second circuit substrate electrically coupled to the first circuit substrate, wherein the first circuit substrate includes a first coupling terminal electrically coupled to the print head, a first electrolytic capacitor, and a first substrate on which the first coupling terminal and the first electrolytic capacitor are provided, wherein the second circuit substrate includes a drive signal output circuit that outputs a drive signal supplied to the first terminal, a constant voltage output circuit that outputs a constant voltage signal supplied to the second terminal, a first output terminal that is electrically coupled to the first circuit substrate, and through which the drive signal is output to the first circuit substrate, a second output terminal that is electrically coupled to the first circuit substrate, and through which the constant voltage signal is output to the first circuit substrate, a first input terminal that is electrically coupled to the first circuit substrate, and through which a base drive signal that is a basis of the drive signal is input from the first circuit substrate, and a second substrate on which the drive signal output circuit, the constant voltage output circuit, the first output terminal, the second output terminal, and the first input terminal are provided, wherein the first electrolytic capacitor is electrically coupled to the second output terminal and the first coupling terminal, the drive signal output circuit amplifies a signal based on the base drive signal based on an amplified voltage signal to generate the drive signal, wherein the first circuit substrate includes a second coupling terminal through which the amplified voltage signal is input and a second electrolytic capacitor, wherein the second circuit substrate includes a second input terminal that is electrically coupled to the first circuit substrate, and through which the amplified voltage signal is input from the first circuit substrate, and wherein the second electrolytic capacitor is electrically coupled to the second input terminal and the second coupling terminal.

2. The liquid ejecting apparatus according to claim 1, wherein a shortest distance between the first electrolytic capacitor and the second output terminal is shorter than a shortest distance between the first electrolytic capacitor and the first input terminal.

3. The liquid ejecting apparatus according to claim 1, wherein a shortest distance between the second electrolytic capacitor and the second input terminal is shorter than a shortest distance between the second electrolytic capacitor and the second output terminal.

4. The liquid ejecting apparatus according to claim 1, wherein when viewed from a direction orthogonal to one face of the first substrate, the first circuit substrate and the second circuit substrate are disposed so that at least part of one face of the first substrate and one face of the second substrate overlap each other.

5. The liquid ejecting apparatus according to claim 1, wherein the second circuit substrate is detachably attached to the first circuit substrate.

6. A drive circuit including a first terminal and a second terminal, the drive circuit driving a drive element that is driven by a potential difference between the first terminal and the second terminal, the drive circuit comprising:

a first circuit substrate electrically coupled to the drive element; and a second circuit substrate electrically coupled to the first circuit substrate, wherein the first circuit substrate includes a first coupling terminal electrically coupled to the drive element, a first electrolytic capacitor, and a first substrate on which the first coupling terminal and the first electrolytic capacitor are provided, wherein the second circuit substrate includes a drive signal output circuit that outputs a drive signal supplied to the first terminal, a constant voltage output circuit that outputs a constant voltage signal supplied to the second terminal, a first output terminal that is electrically coupled to the first circuit substrate, and through which the drive signal is output to the first circuit substrate, a second output terminal that is electrically coupled to the first circuit substrate, and through which the constant voltage signal is output to the first circuit substrate, a first input terminal that is electrically coupled to the first circuit substrate, and through which a base drive signal that is a basis of the drive signal is input from the first circuit substrate, and a second substrate on which the drive signal output circuit, the constant voltage output circuit, the first output terminal, the second output terminal, and the first input terminal are provided, wherein the first electrolytic capacitor is electrically coupled to the second output terminal and the first coupling terminal, the drive signal output circuit amplifies a signal based on the base drive signal based on an amplified voltage signal to generate the drive signal, wherein the first circuit substrate includes a second coupling terminal through which the amplified voltage signal is input and a second electrolytic capacitor, wherein the second circuit substrate includes a second input terminal that is electrically coupled to the first circuit substrate, and through which the amplified voltage signal is input from the first circuit substrate, and wherein the second electrolytic capacitor is electrically coupled to the second input terminal and the second coupling terminal.

* * * * *